US007757669B2

(12) United States Patent
Okamoto et al.

(10) Patent No.: US 7,757,669 B2
(45) Date of Patent: Jul. 20, 2010

(54) HIGH-PRESSURE FUEL PUMP CONTROL APPARATUS FOR AN INTERNAL COMBUSTION ENGINE

(75) Inventors: Takashi Okamoto, Hitachinaka (JP); Kenichiro Tokuo, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 262 days.

(21) Appl. No.: 11/831,471

(22) Filed: Jul. 31, 2007

(65) Prior Publication Data

US 2008/0025849 A1 Jan. 31, 2008

(30) Foreign Application Priority Data

Jul. 31, 2006 (JP) ..... 2006-207873

(51) Int. Cl.
*F02M 37/06* (2006.01)
*F02M 37/04* (2006.01)

(52) U.S. Cl. ..... 123/508; 123/510

(58) Field of Classification Search ..... 123/510, 123/501, 500, 496, 503, 504, 508, 456, 495, 123/499, 506, 458
See application file for complete search history.

(56) References Cited

U.S. PATENT DOCUMENTS 6,332,454 B1 12/2001 Itabashi et al.
6,701,898 B2 * 3/2004 Tokuo et al. ..... 123/456
2006/0157032 A1 7/2006 Hori
2006/0222518 A1 10/2006 Oda et al.

FOREIGN PATENT DOCUMENTS

| | | | |
|---|---|---|---|
| EP | 1 241 349 | A2 | 9/2002 |
| EP | 1 674 717 | A1 | 6/2006 |
| JP | 2000-8997 | A | 1/2000 |
| JP | 2001-050092 | A | 2/2001 |
| JP | 2005-23942 | A | 1/2005 |
| JP | 2005-291213 | A | 10/2005 |
| JP | 2006-170115 | A | 6/2006 |

OTHER PUBLICATIONS

European Search Report dated Nov. 20, 2007 (Seven (7) pages).
Japanese Office Action dated Oct. 28, 2008, with English translation (four (4) pages.

* cited by examiner

*Primary Examiner*—Mahmoud Gimie
(74) *Attorney, Agent, or Firm*—Crowell & Moring, LLP

(57) ABSTRACT

A control device for a high-pressure fuel pump for an internal combustion engine having a solenoid valve installed as a suction valve in a fuel charging passage to a pressurized chamber. A pump suction pressure generated in the pressurized chamber in the charging stroke is exerted on the solenoid valve in a valve opening direction. The solenoid valve is closed at OFF state of an electric driving signal and opened at ON state of the electric driving signal, so that a discharging rate of the high-pressure fuel pump of variable discharge rate type is controlled by an opening and closing control of the solenoid valve.

16 Claims, 25 Drawing Sheets

HIGH-PRESSURE FUEL PUMP CONTROL APPARATUS FOR AN INTERNAL COMBUSTION ENGINE

CLAIM OF PRIORITY

The present application claims priority from Japanese application serial no. 2006-207873 filed on Jul. 31, 2006, the contents of which are hereby incorporated by reference into this application.

BACKGROUND OF THE INVENTION

The present invention relates to a high-pressure fuel pump control apparatus for an internal combustion engine mounted on automobiles, and the like, and in particular, a high-pressure fuel pump control apparatus for an internal combustion engine used for a fuel supply system of in-cylinder injection engines.

Recently, automobiles are required to reduce carbon oxide (CO), hydrocarbon (HC), nitrogen oxide (NOx) and the like, included in the emission gas substances from a viewpoint of environment conservation. As an automobile engine for reducing these substances, in-cylinder injection engines have been developed. In the in-cylinder injection engine, the fuel is injected directly through a fuel injection valve into the combustion chamber of the cylinders. By lessening particle diameter of the fuel injected through the fuel injector valve, the combustion of the injected fuel in the combustion chamber is promoted in order to reduce the emission gas substances and improve the engine output.

To decrease the particle diameter of the fuel injected from the injection valve, a means for high pressurization of the injected fuel is required, and various kinds of high-pressure fuel pumps for sending high-pressurized fuel to the solenoid valve as well as control techniques for the high-pressure fuel pump have been proposed.

For example, as a fuel pressure pump used for the in-cylinder injection engine, a high-pressure fuel pump which controls the flow rate of the high-pressure fuel supplied in response to the injected fuel quantity of the fuel injection valve by actuating closing timing of the solenoid valve mounted as a pump suction valve is well-known (For example, Japanese laid-open patent publication 2000-8997). The solenoid valve used for the high-pressure pump includes two types of solenoid valves, a normal open type, which is closed by the power energization, and a normal close type, which is opened by the power energization.

In a high-pressure pump which provides a normal close type solenoid valve as a suction valve, when the power energization to the solenoid valve is carried out in the pump compression stoke, the solenoid valve is opened to prevent discharging fuel, on the other hand, when the power energization to the solenoid valve is not carried out under the pump compression stoke, the solenoid valve is closed to perform fuel discharging. Thereby, the full discharge is realized by non-power energization.

As the high-pressure fuel pump control apparatus, the following type has been proposed. Rising of the fuel pressure can be promoted from the engine starting, by outputting driving signals to the high-pressure fuel pump at least more than two times, from a signal detection timing of the crank angle sensor of the engine until a time point when a phase between the current crank angle sensor and a cam angle sensor detecting position of high-pressure fuel pump driving cam is decided. Thereby, it is possible to shorten the engine start time period, reduce emission gas substances and increase the engine output, for example, as shown in Japanese laid-open patent publication 2005-23942.

A high-pressure fuel pump having a normal close type solenoid valve realizes full discharge with good pressure rising responsibility by non-power energization, however there is a possibility to energize continuously during long time in the case depending on the engine operation mode. For example, in the state which no fuel is used such as engine braking, the solenoid valve is energized continuously to maintain in valve opening state during the full period of pump compression stroke so as not to discharge continuously fuel by the high-pressure pump. As a result, it causes problems such as over heat of the solenoid valve and increase of energy consumption of the entire system and the driving circuit load.

Additionally, in the power energization control to the solenoid valve, unless appropriate start and finish of the power energization are performed, unintentional increase and decrease of pressure are caused in the pressure accumulating chamber (hereinafter referred to as common rail), and the pressure of the high-pressure fuel supplied to the fuel injector does not reaches a target fuel pressure to realize the most suitable combustion and results in the deterioration of combustion stability and emission gas property.

SUMMARY OF THE INVENTION

Considering the above problems, an object of the invention is to provide a high-pressure pump control system for performing optimum control of a high-pressure fuel pump having a normal close type solenoid valve as a suction valve and for improving stabilization of the internal combustion engine fuel system, stabilization of the combustion and emission gas property.

To establish the object, the present invention is configured as follows.

A control device for a high-pressure fuel pump for an internal combustion engine; the high pressure fuel pump comprising:

a pressurizing member being reciprocated by rotation of a pump driving cam mounted on the internal combustion engine; a pressurized chamber whose volume is varied by reciprocation of the pressurizing member to perform pump action by repeating a charging stroke and a discharging stroke; and a solenoid valve which is installed as a suction valve in a fuel charging passage to the pressurized chamber such that a pump suction pressure generated in the pressurized chamber in the charging stroke is exerted on the solenoid valve in a valve opening direction, and that is closed at OFF state of an electric driving signal and opened at ON state of the electric driving signal, so that a discharging rate of the high-pressure fuel pump of variable discharge rate type is controlled by an opening and closing control of the solenoid valve, the control apparatus is characterized in that an output as to the ON state of the electric driving signal for the solenoid is set to start on the way of the charging stroke of the high-pressure fuel pump.

Further to establish an object, a control device for a high-pressure fuel pump for an internal combustion engine; the high pressure fuel pump comprising:

a pressurizing member being reciprocated by rotation of a pump driving cam mounted on the internal combustion engine; a pressurized chamber whose volume is varied by reciprocation of the pressurizing member to perform pump action by repeating a charging stroke and a discharging stroke; and a solenoid valve which is installed as a suction valve in a fuel charging passage to the pressurized chamber such that a pump suction pressure generated in the pressurized chamber in the charging stroke is exerted on the solenoid valve in a valve opening direction, and that is closed at OFF state of an electric driving signal and opened at ON state of the electric driving signal, so that a discharging rate of the high-pressure fuel pump of variable discharge rate type is controlled by an opening and closing control of the solenoid valve, the control apparatus is characterized in that a finish timing of ON state output of the electrical driving signal is limited to a predetermined phase on the way of a compression stroke of the high-pressure fuel pump.

Additionally, to establish an object, a control device for a high-pressure fuel pump for an internal combustion engine; the high pressure fuel pump comprising:

a pressurizing member being reciprocated by rotation of a pump driving cam mounted on the internal combustion engine; a pressurized chamber whose volume is varied by reciprocation of the pressurizing member to perform pump action by repeating a charging stroke and a discharging stroke; and a solenoid valve which is installed as a suction valve in a fuel charging passage to the pressurized chamber such that a pump suction pressure generated in the pressurized chamber in the charging stroke is exerted on the solenoid valve in a valve opening direction, and that is closed at OFF state of an electric driving signal and opened at ON state of the electric driving signal, so that a discharging rate of the high-pressure fuel pump of variable discharge rate type is controlled by an opening and closing control of the solenoid valve, the control apparatus is characterized in that the On state of the electric driving signal is configured by a first energization signal part continuously output initially during a predetermined time period and a second energization signal part output with duty signal after the first energization signal part.

A high-pressure fuel pump control apparatus in accordance with the present invention is capable of reducing heat quantity of the solenoid provided with the high-pressure pump and turning on or off with high fuel pressure responsibility using wide controllable range driving signal and improving the stabilization of the fuel system and combustion as well as emission gas property.

DETAILED DESCRIPTION OF THE INVENTION

An embodiment in accordance with the present invention is explained with reference to drawings.

Figure 1:
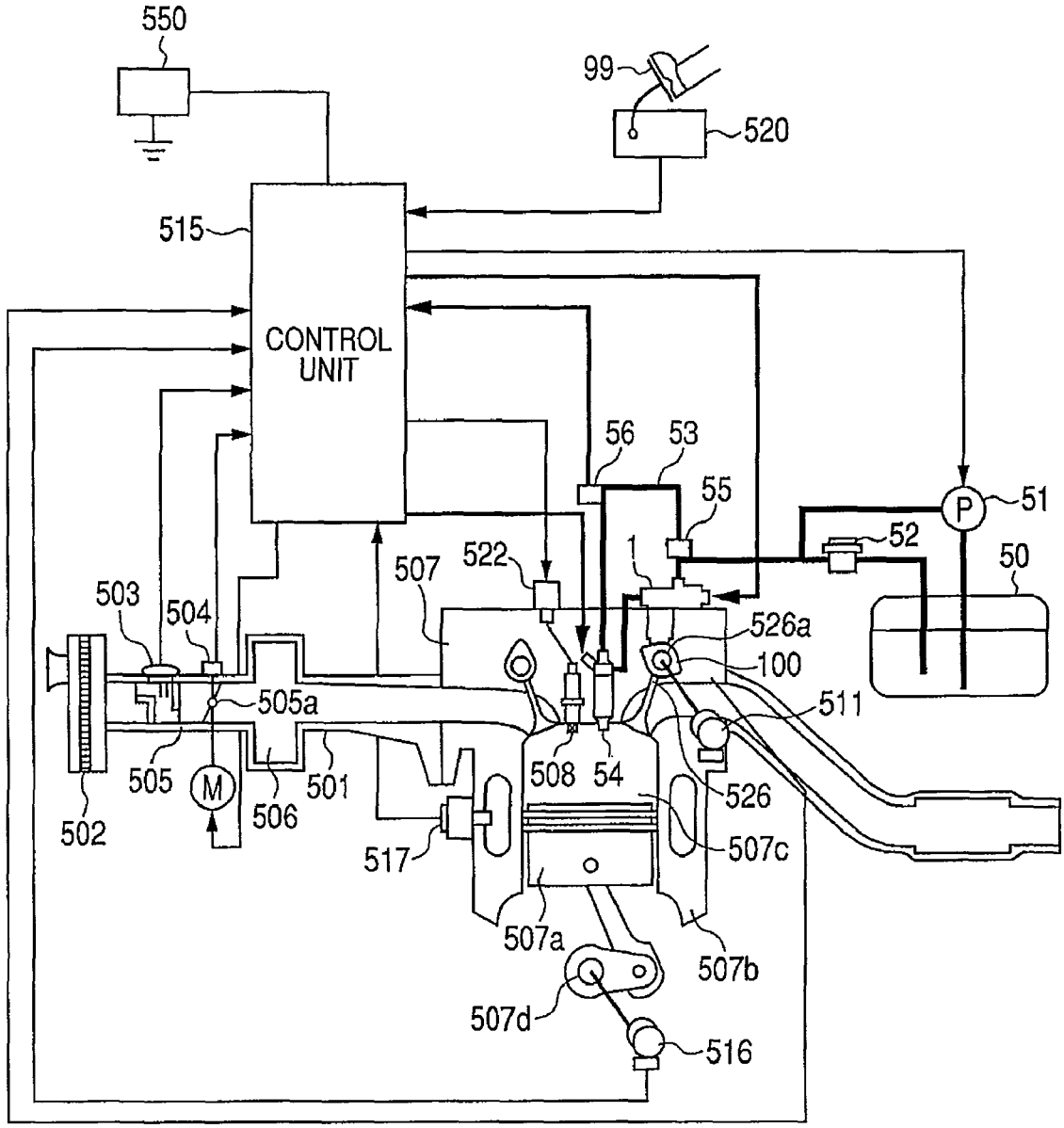
FIG. 1 is a view showing an entire structure of one embodiment of an in-cylinder injection engine to which a high-pressure fuel pump control apparatus of an internal combustion engine is applied in accordance with the present invention.

FIG. 1 shows an entire structure of an in-cylinder injection engine 507 to which the high-pressure fuel pump control apparatus according to the present invention is applied.

The in-cylinder injection engine 507 is a multi cylinders, for example, a four cylinders engine, and has combustion chambers 507*c* by number of cylinders by respective pistons 507*a*, cylinder blocks 507*b* and the like.

Air is distributed and fed into the respective combustion chamber 507*c* by an air intake manifold 501 connected to each combustion chamber, from an inlet of an air cleaner 502 through an air flow sensor 503, a throttle body 505 with an electrical controlled throttle valve 505*a* for controlling an intake air flow rate, and a collector 506.

The airflow sensor 503 outputs a signal indicative of the intake air flow rate to an engine control system (control unit) 515.

A throttle body 505A is provided with a throttle sensor 504 for sensing an opening degree of the electrical controlled throttle valve 505. The throttle sensor 504 outputs a signal indicative of the opening degree of the throttle valve to the control unit 515.

The fuel, such as gasoline, is fed from a fuel tank 50 and firstly pressurized by a electrical driven type fuel pump 51 as a low-pressure fuel pump 51 and regulated by a fuel pressure regulator 52 to a constant pressure (for example 3 kg/cm$^2$) and additionally, secondly pressurized to higher pressure, for example, 50 kg/cm$^2$ by a high-pressure fuel pump 1. The high-pressure fuel pump 1 is a cam driven type and driven by a pump driving cam 100 mounted on a camshaft 52 for an exhaust valve 526.

The secondly pressurized high-pressure fuel is fed to a common rail 53 and directly injected into the combustion chamber 507*c* from the fuel injection valve mounted for each combustion chamber 507*c*. The common rail 53 has a necessary volume and forms an accumulating chamber for the high-pressure fuel.

The fuel injected to the combustion chamber 507*a* forms fuel-air mixture with taken in air, and the mixture is ignited with an ignition plug 508 energized by a high voltage ignition signal produced with an ignition coil 522.

A crank angle sensor 516 (hereinafter referred to as a position sensor) is attached to a crankshaft 507*d* of the engine 507. The position sensor 516 outputs a signal indicating a revolution position (namely, a crank angle sensor signal CRANK=a position sensor signal) to the control unit 515. The control unit 515 computes an engine speed from the output of the position sensor 516.

A cam angle sensor (hereinafter referred to as a phase sensor) is attached to the camshaft 526*a* of the exhaust valve 526. The phase sensor 511 outputs an angle signal (namely, a cam angle sensor signal CAM=a phase sensor signal) indicative of a revolution position of the camshaft 526*a* to the control unit 515.

As the pump driving cam 100 of the high-pressure fuel pump is attached to the cam shaft 526*a* of the exhaust valve 526, the angle signal indicative of the revolution position of the cam shaft 526*a* output by the phase sensor 511 is processed as an angle signal indicative of the rotation position of the pump driving cam 100 of the high-pressure fuel pump 1, too.

A water temperature sensor 517 is attached to a cylinder block 507*b*. The water temperature sensor 517 outputs a water temperature signal indicative of a cooling water temperature to the control unit 515.

Entire structure of an engine fuel system with the high-pressure fuel pump 1 and the high-pressure fuel pump 1 are explained in detail with reference to FIG. 2 and FIG. 3.

The high-pressure fuel pump 1 further pressurizes the preliminarily pressurized fuel by the low-pressure fuel pump 51 into a high pressure and feeds the high-pressure fuel the common rail 53. The high-pressure fuel pump 1 has a fuel charging passage 10, a fuel discharging passage 11, a pressurized chamber 12 and a plunger 2. The pressurized chamber 12 varies its volume by reciprocation of the plunger 2 acting as a pressurizing member. A discharge valve 6 with a check valve structure is installed to the fuel discharging passage 11 to prevent the high-pressure fuel of the downstream side from flowing back to the pressurized chamber 12. A solenoid valve 8 acting as a pump suction valve for controlling the suction of the fuel is installed in the fuel charging passage 10.

Figure 2:
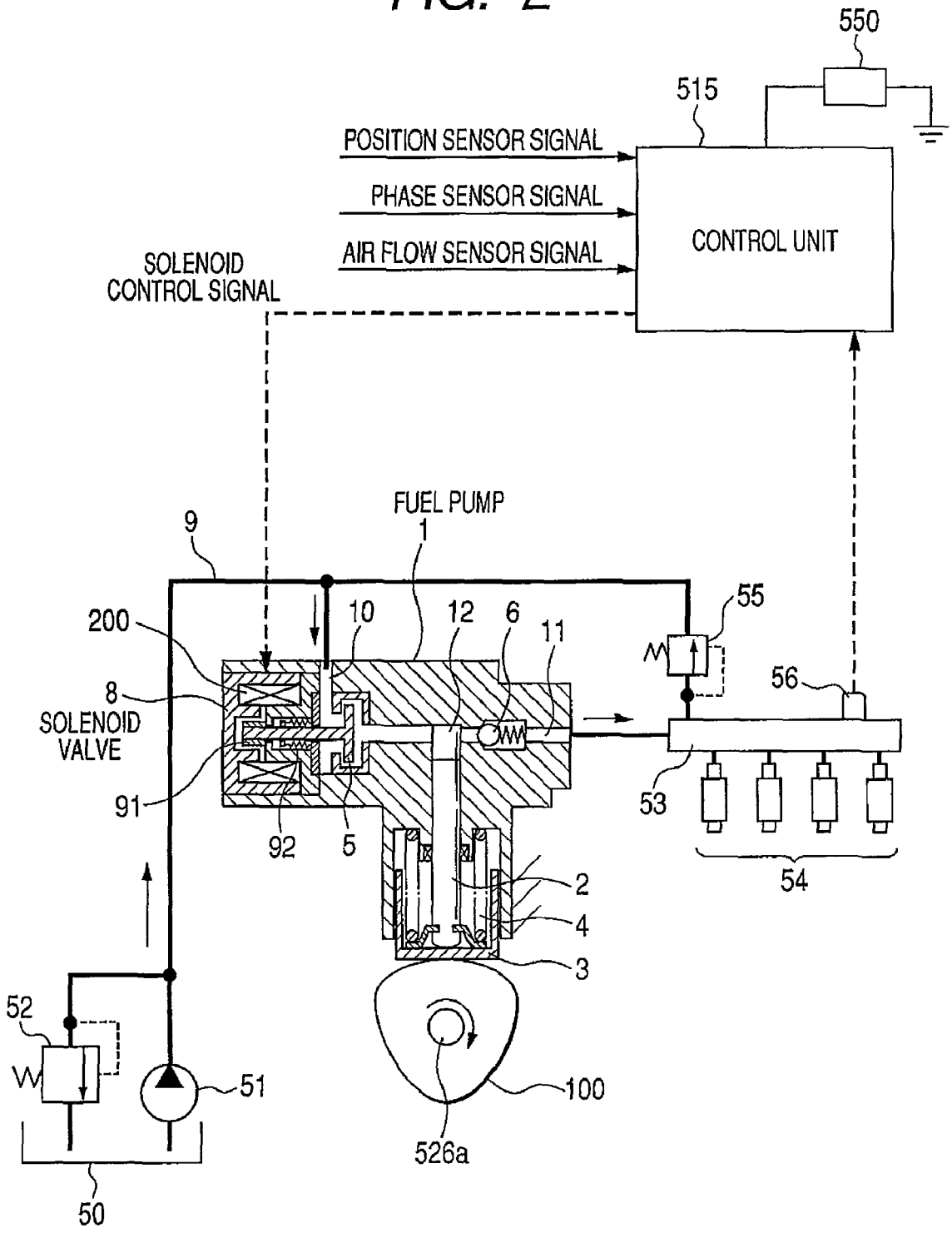
FIG. 2 is a structural view showing one embodiment of the in cylinder injection engine using the high-pressure fuel pump control apparatus of the internal combustion engine in accordance with the present invention.
Figure 3:
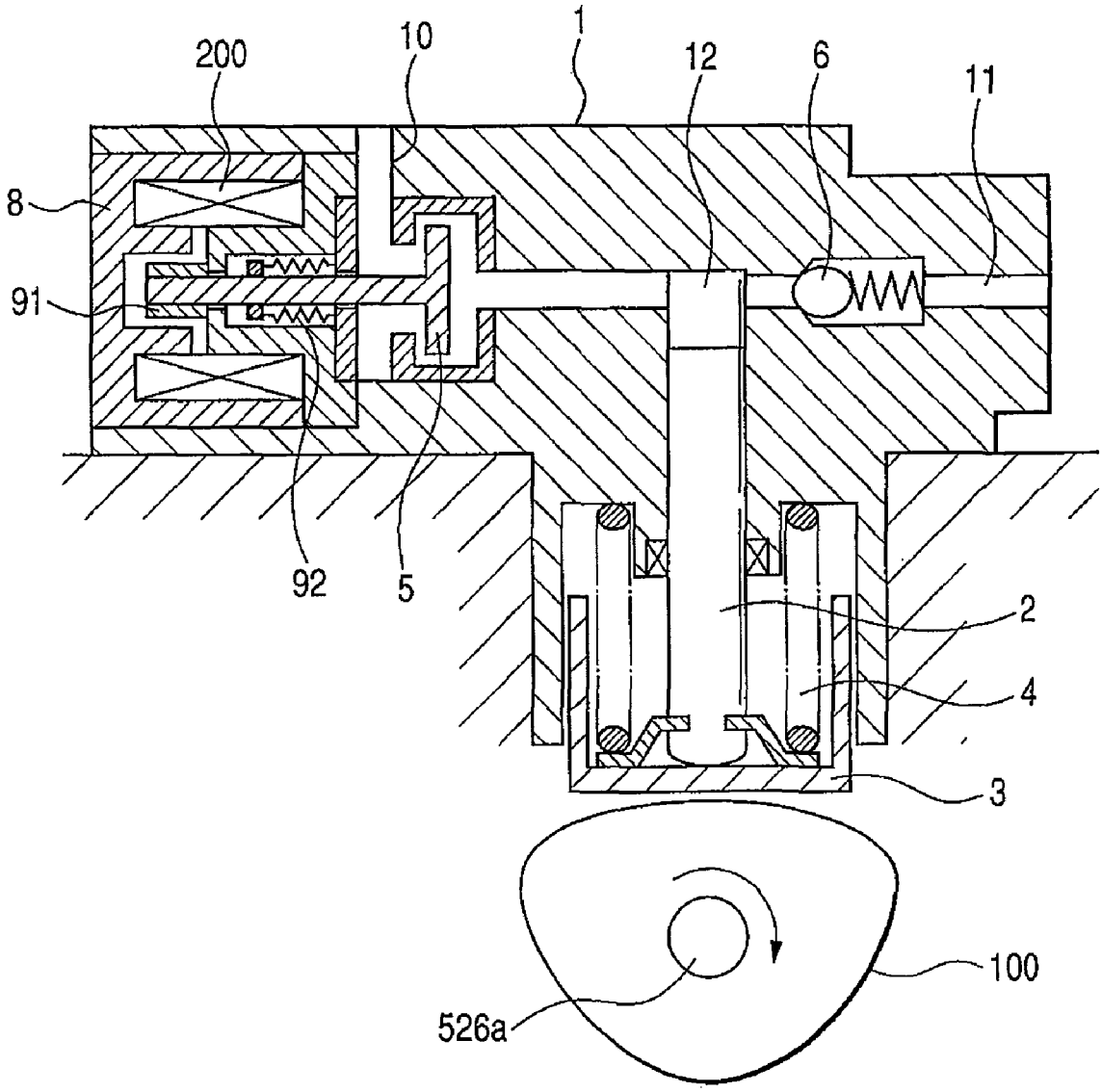
FIG. 3 is a structural view showing one embodiment the high-pressure fuel pump control apparatus of the internal combustion engine in accordance with the present invention.

The solenoid valve 8 has a valve element 5, a valve closing spring 92 energizing the valve in the closing direction, a solenoid 200, and an anchor 91 as structural parts, when a current flows through the solenoid 200, the anchor 91 is pulled toward right side by an electromagnetic force as shown in FIG. 2 and the valve 5 integrated with the anchor 91 is moved toward the right side to open the valve. When no current flow through the solenoid 200, the anchor 91 is moved toward left side to close the valve. As above, the solenoid 8 closes during a state in which no current flows through the solenoid 200, and therefore, is called as a normal close type solenoid valve.

A pump suction pressure exerts to the valve element 5 in the valve opening direction in the charging stroke of the pump, it opens against the force of pump valve closing spring 92 regardless of the power energization to the solenoid valve 200.

The plunger 2 is reciprocated with a lifter 3 which is pushed to the pump driving cam 100 and operated by the rotation of the cam 100; wherein the cam 100 rotates in accordance with the rotation of the camshaft 526*a* for the discharge valve 526 of the engine 507. The volume of the pressurized chamber 12 is varied by the reciprocation of the plunger 2. When the plunger 2 goes down and the volume of the pressurized chamber 12 becomes large and the solenoid valve 8 is opened, the fuel flows into the pressurized chamber 12 through the fuel charging passage 10. The stroke where the plunger 2 goes down is called as a charging stroke. When the plunger 2 goes up and the solenoid valve 8 is closed, the fuel in the pressurized chamber 12 is further pressurized and sent the pressurized fuel to the common rail 53 through the discharging valve 6. The stroke where the plunger 2 goes up is called as compression stroke.

Figure 4:
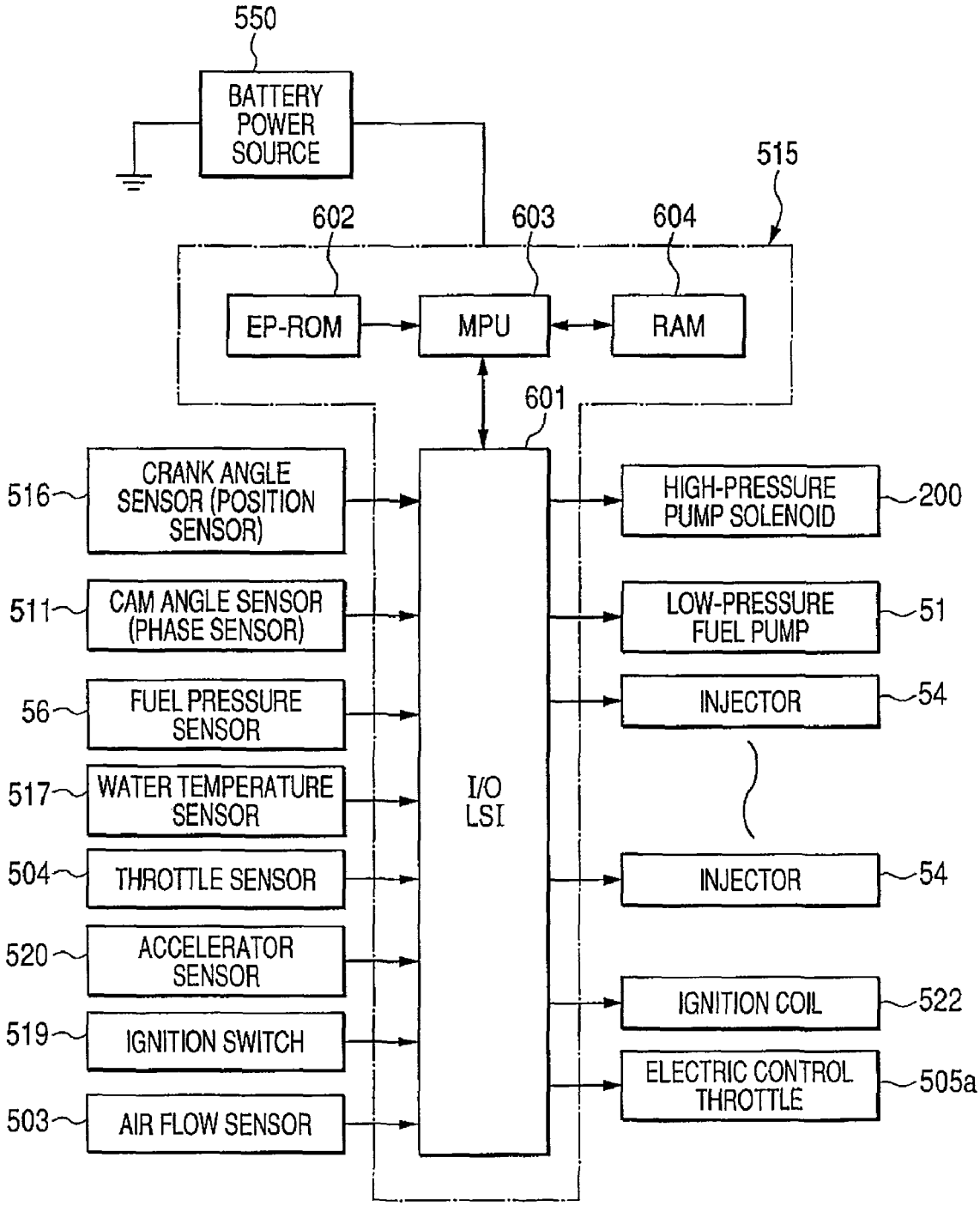
FIG. 4 is a block diagram showing an embodiment of the control unit of in cylinder internal combustion engine.

The common rail 53 is provided with a plurality of fuel injection valves (hereinafter referred to as injector) 54 corresponding to the number of cylinders of the engine 507, a pressure regulation valve (hereinafter referred to as relief valve) 55 and a fuel pressure sensor 56 (pressure detecting means). The relief valve 55 serves as a regulation valve which is opened when the fuel pressure exceeds a predetermined value and regulates the pressure by returning the fuel to low-pressure side to prevent breakage of the piping system. The injectors 54 are mounted corresponding to the number of the cylinders of the engine 507, and each of them injects the fuel in response to the driving current supplied from the control unit 515. The fuel pressure sensor measures a fuel pressure in the common rail 53 and outputs the obtained data of pressure to the control unit 515. As shown in FIG. 4, the control unit 515 is a type of a microcomputer structured by a MPU603, EP-ROM 602, RAM 604 and I/O LSI 1601 including A/D converter and the like, and the high-pressure fuel pump control apparatus is realized by software processing.

The control unit 515 takes in signals from various kinds of sensors and switches such as an air flow sensor 503, throttle sensor 504, position sensor 516, phase sensor 511, water temperature sensor 517, fuel pressure sensor 56, accelerator sensor 520 for sensing the depression quantity of an accelerator pedal 99, ignition switch 519 and the like, and executes predetermined calculation processing based on the engine state quantity (for example, a crank rotation angle, throttle opening degree, engine speed, and fuel pressure) from the various kinds of sensors and switches and the like, and outputs these various kinds of signals calculated as a result of the calculation to the solenoid 200 of the high-pressure fuel pump 1, fuel injector valve 54 and ignition coil 522, and executes the fuel discharge quantity control of high-pressure fuel pump 1, fuel injection quantity control of fuel injection valve 54 and ignition timing control.

Figure 5:
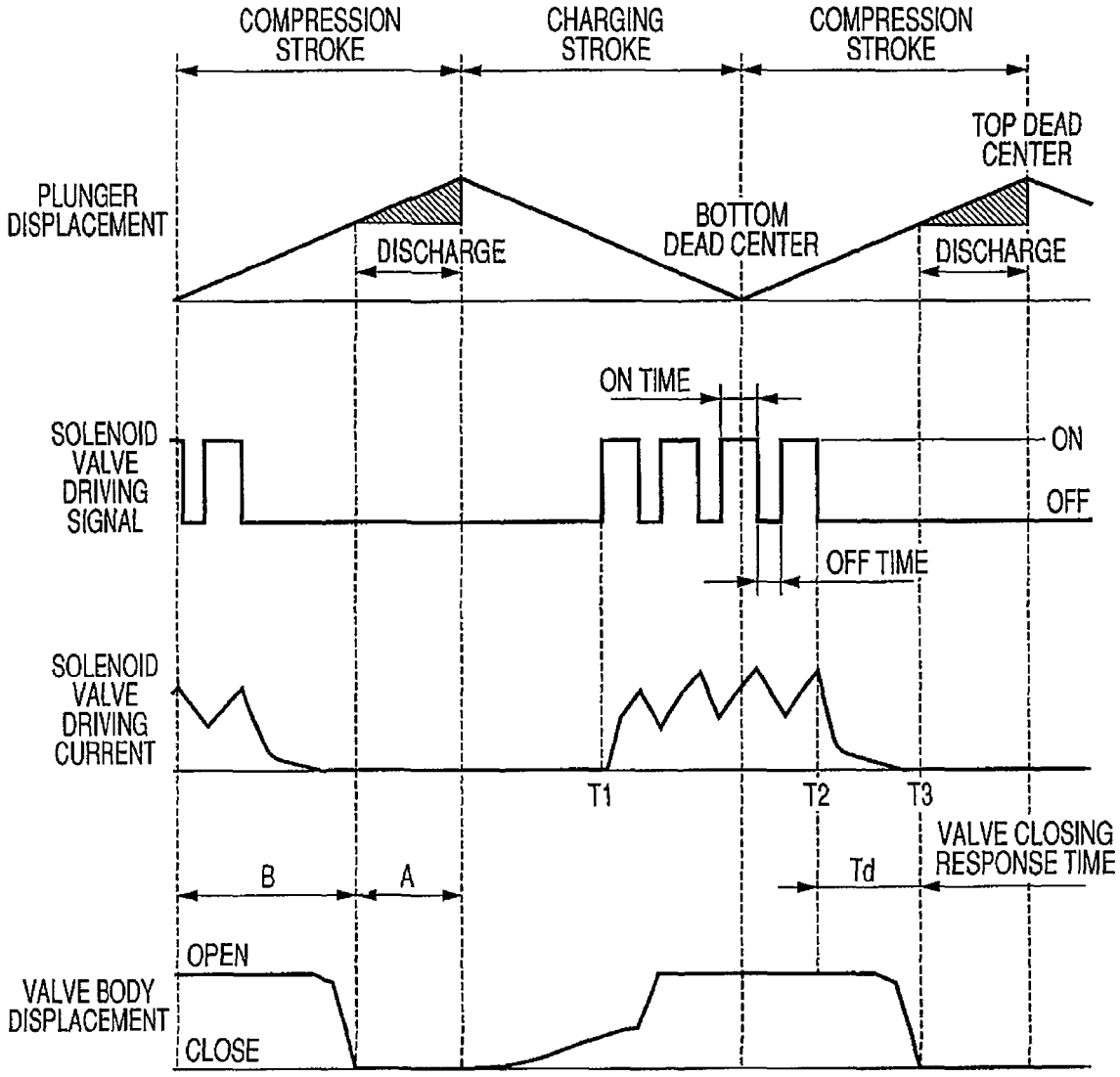
FIG. 5 is an activation-timing chart of the high-pressure fuel pump of the present invention.
Figure 6:
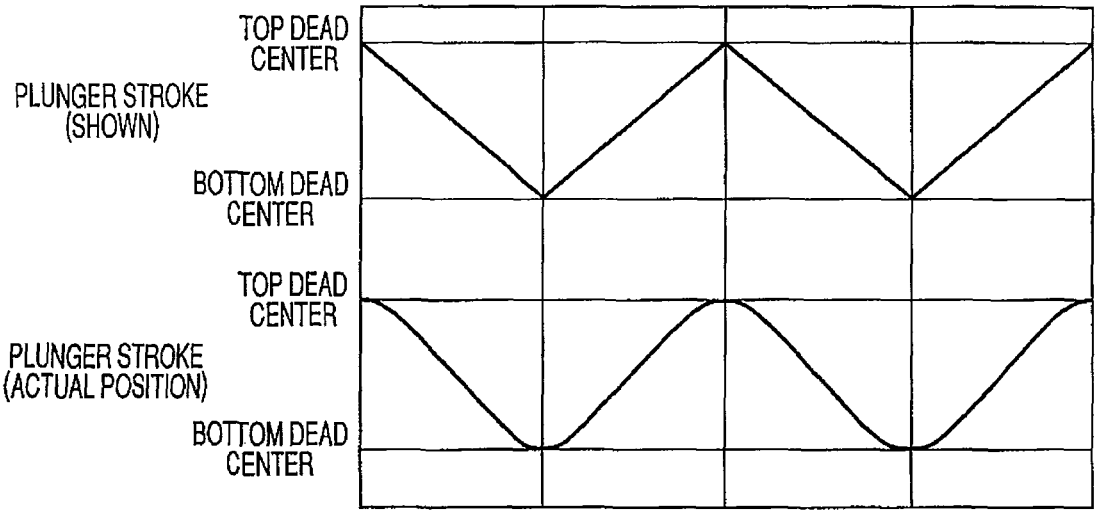
FIG. 6 is a view explaining supplementary activation timing chart of FIG. 5.

Next, an action of the high-pressure fuel pump 1 is explained with reference to the activation chart shown in FIG. 5. An actual stroke of the plunge 2 driven by the pump driving cam 100 (actual position) is shown with a curve in FIG. 6, however, hereinafter, the stroke of the plunger 2 is shown linearly to facilitate understanding of positions of top dead center and bottom dead center.

When the solenoid valve 8 of the high-pressure fuel pump 1 is closed in the compression stroke (section A), the fuel charged into the pressurized chamber 12 in the charging stroke is pressurized and discharged to the common rail 53 sides. On the other hand, when the solenoid valve 8 is opened (section B) in the compression stroke, for the mean time the fuel is pushed back (made backflow) to the fuel charging passage 10 side and the fuel in the pressurized chamber 12 is not discharged to the common rail 53 side. As above, the fuel discharge of the high-pressure pump 1 is controlled by the opening and closing of the solenoid valve 8. The control unit 515 controls the opening and closing of the solenoid valve 8.

During the suction stroke of the pump, the pressure of the pressurized chamber 12 becomes lower than that of the fuel charging passage 10, and a resultant differential pressure opens the valve element 5 to charge the fuel into the pressurized chamber 12. At this time, the valve-closing spring 92 although energizes the valve element 5 in valve closing direction, the valve 5 is opened because the valve opening force by the differential pressure is set so as to be greater than the valve closing force of the spring 92. When the driving current follows through the solenoid 200, an electromagnetic attractive force acts in the opening direction and the valve 5 becomes easier to be opened.

On the other hand, when the pressure in the pressurized chamber 12 becomes higher than that of the fuel charging passage 10 in the compression stroke, no differential pressure for opening the valve 5 causes. Under this condition, the spring force of the valve closing spring 92 closes the valve element 5. To the contrary, when the driving current flows through the solenoid 200 and sufficient electromagnetic force is generated, the electromagnetic attractive force energizes the valve element 5 in the direction of valve opening.

Therefore, the valve element 5 is maintained in the valve opening state when the driving current starts flowing through the solenoid 200 of the solenoid valve 8 at time point T1 in the charging stroke and continues flowing through the solenoid 200 until a part of the compression stroke. In the mean time, the fuel is not sent to the common rail 53, because the fuel in the pressurized chamber 12 flows back to the fuel charging passage 10. After that, when the driving current for solenoid 200 is stopped at a timing, for example, the time point T2, the valve element 5 is closed at the time point T3 when the valve closing response time Td is lapsed and in the later compression stroke. Thereby, the fuel in the pressurized chamber 12 is pressurized and the pressurized fuel is discharged to a fuel discharging passage 11 side.

Accordingly, the earlier timing for stopping supply of the driving current to the solenoid in the compression stroke, the volume of the pressurized fuel becomes large. In contrast to this, the later the timing for stopping supply of the driving current, the volume of the pressurized fuel becomes small. Therefore, the control unit 515 is capable of controlling discharge rate of the high-pressure fuel pump 1 by valve closing timing control through driving current control (power energization OFF timing).

In addition, appropriate the power energization-OFF timing is calculated based on the signal from the fuel pressure sensor 56, and a feedback compensation control for rendering the pressure of the common rail 53 to a target value can be executed by controlling the solenoid 200.

Here, in electrical signals where the control unit 515 outputs to the solenoid 200 as solenoid control signals, a signal for flowing the driving current through the solenoid 200 means an electrical driving signal ON, and a signal for flowing no driving current through solenoid 200 means an electrical driving OFF.

Figure 7:
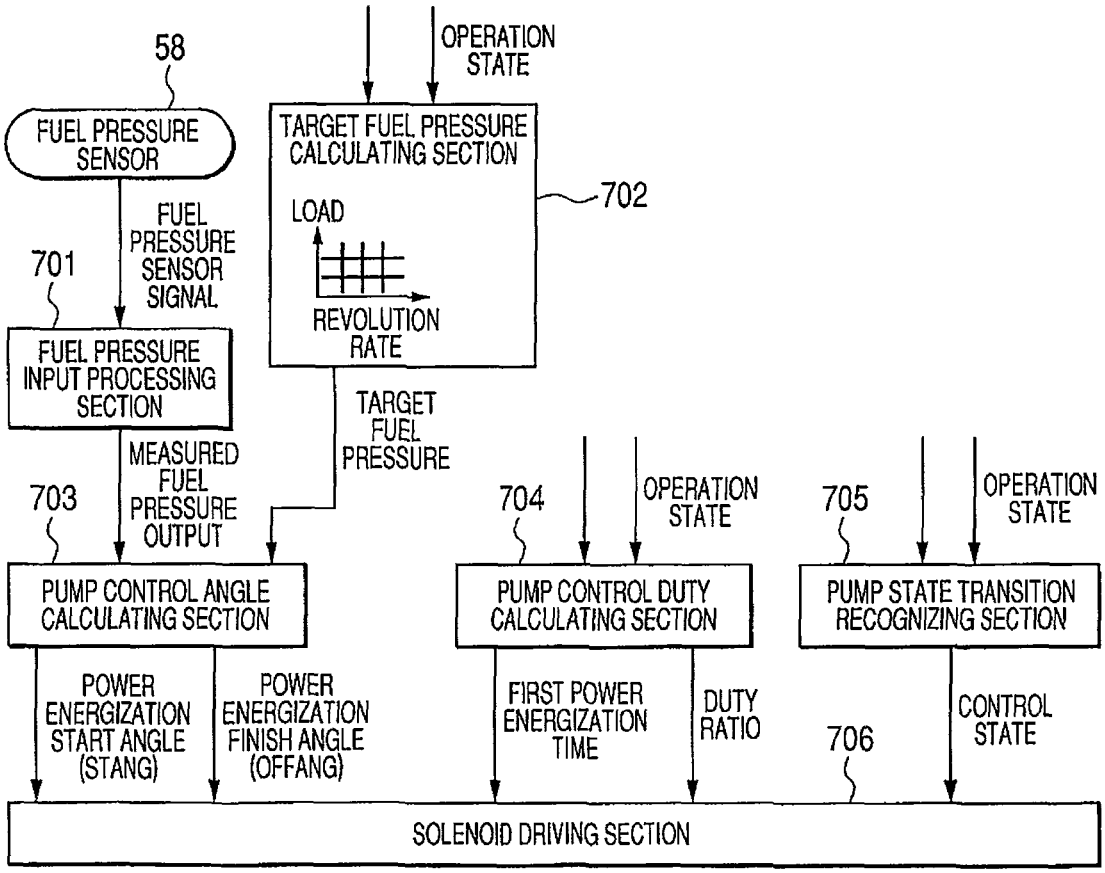
FIG. 7 is block diagram showing an embodiment of the high-pressure fuel pump control apparatus of the internal combustion engine.

FIG. 7 is showing an embodiment of the A-control block of the high-pressure fuel pump 1 in which the MPU 603 of the control unit 515 including high-pressure fuel pump control device according to the present invention is performed.

The high-pressure fuel pump control device of the embodiment comprises a fuel pressure input processing section 701 for outputting an actual fuel pressure value after filtering processing the signal from fuel pressure sensor 56, a target fuel pressure calculating section 702 for calculating a target fuel pressure value most suitable for an engine speed and engine load based on sensed an engine speed and engine load, a pump control angle calculating section 703 for calculating phase parameter (power energization start angle STANG, power energization finish angle OFFANG) to control the amount of the discharge flow rate of the high-pressure fuel pump 1, a pump control DUTY calculating section 704 for calculating parameters (power energization time) of the pump driving signal (solenoid valve driving signal=solenoid control signal), a pump state transition recognizing section 705 for recognizing state of the in-cylinder injection engine 507 and changing pump control mode, and a solenoid driving section 706 for supplying the current obtained from parameters generated based on above described calculating means 703, 704, and recognizing means 705 to the solenoid 200.

Figure 8:
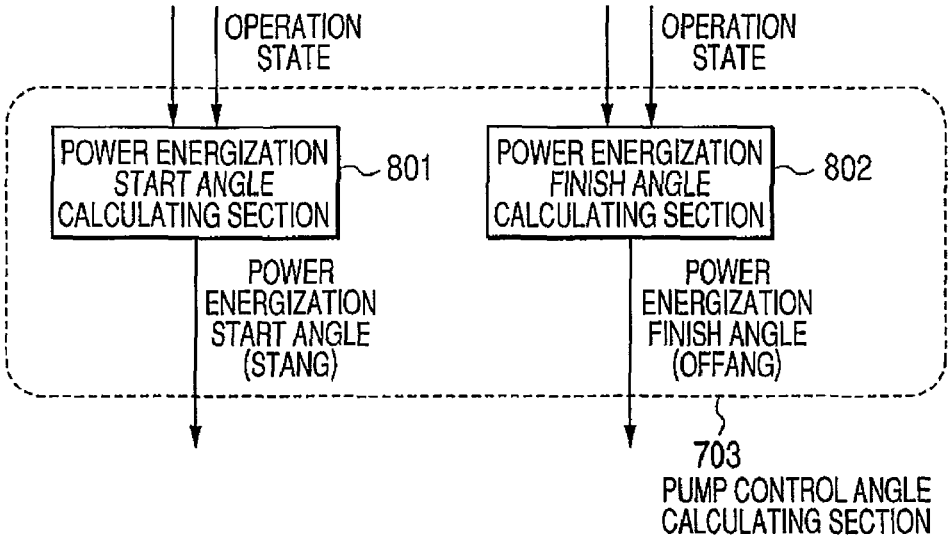
FIG. 8 is a block diagram showing detail of a pump control angle calculating section of the high-pressure fuel pump of the internal engine in the embodiment of the invention.

As shown in FIG. 8, the pump control angle calculating section 703 includes a power energization start angle calculating section 801 for calculating the power energization start angle STANG, and a power energization finish angle calculating section 802 for calculating the power energization finish angle OFFANG. The amount of the fuel discharge of the high-pressure fuel pump 1 is controlled by varying the power energization finish angle OFFANG.

Figure 9:
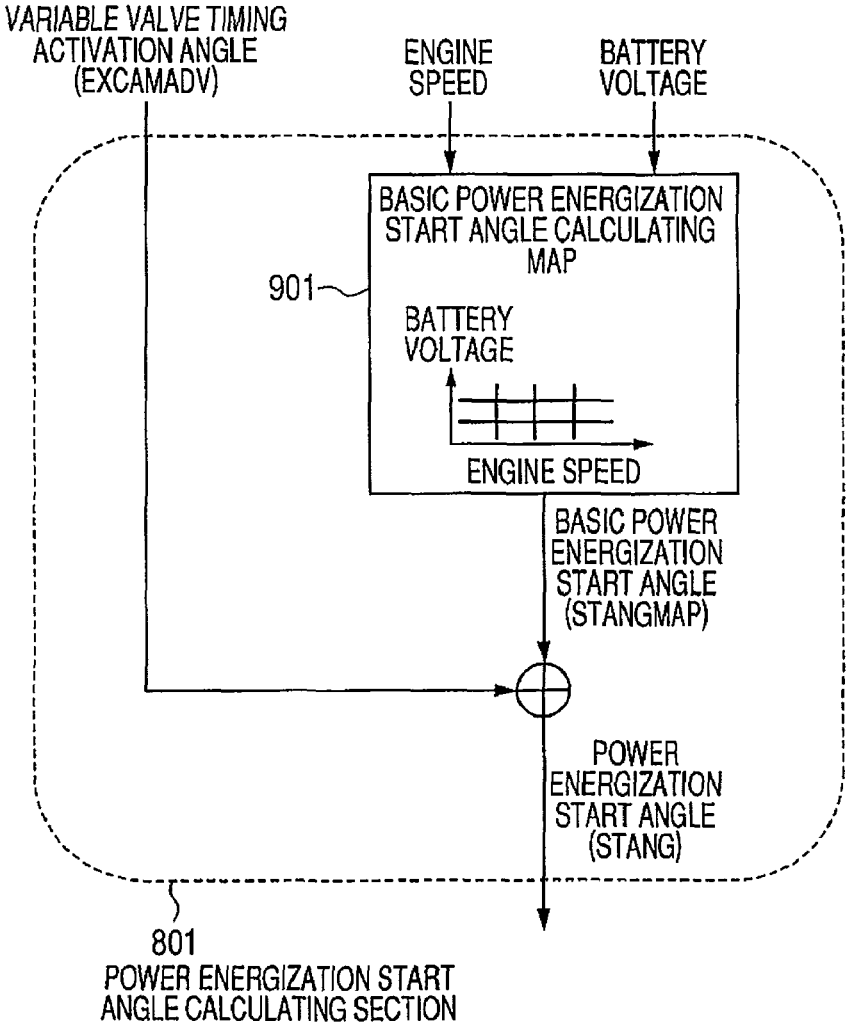
FIG. 9 is a block diagram showing detail of a power energization start angle calculating section of the high-pressure fuel pump of the internal combustion engine in the embodiment according to the present invention.

The power energization start angle calculating section 801 as shown in FIG. 9, calculates the power energization start angle STANG by calculating the basic power energization start angle STANGMAP based on a map 901 related with the engine speed and a battery voltage (power source voltage) of a battery 550 which is a power source of the solenoid valve; and the section 801 further calculates the power energization start angle STANG by correcting the basic power energization start angle STANGMAP by a phase difference EXCAMADV due to a variable valve timing mechanism of the pump driving cam shaft (cam shaft of the discharge valve 526*a*).

The correction of the phase difference due to the variable valve timing mechanism performs a subtraction in the case of when the valve timing mechanism operates toward an advancing angle side with respect to an operating angle 0 position. In contrast to this, and the correction thereof performs an addition in the case of the timing mechanism operates toward a retarding angle side with respect to an operating angle 0 position. In the present embodiment, the variable valve timing mechanism operating toward the retarding angle side is assumed. Hereinafter, in the pump control phase parameter, a part necessary for the phase correction due to the variable valve timing mechanism is based on the same thought.

Figure 10:
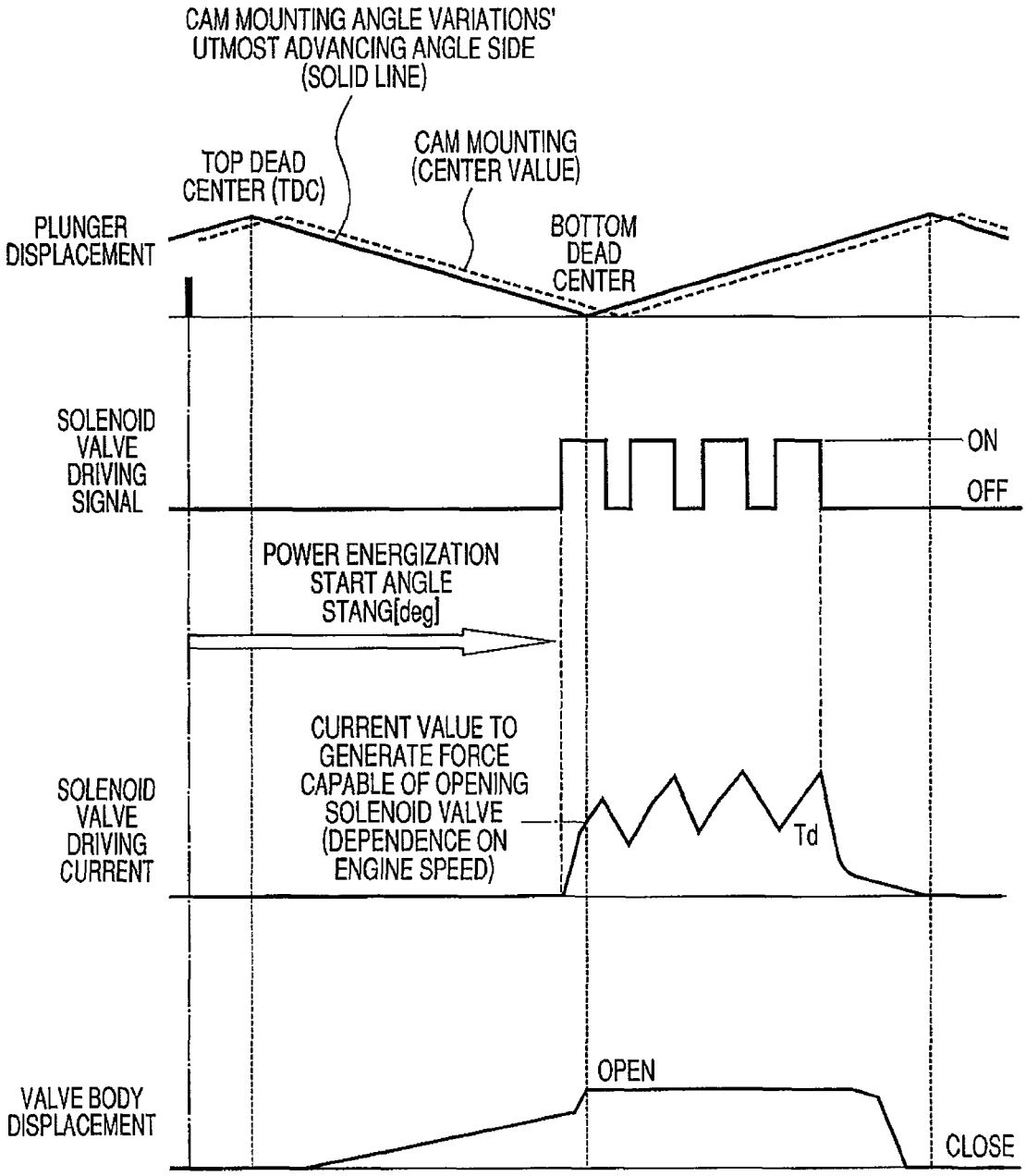
FIG. 10 is a time chart relating to setting of the basic power energization by the embodiment.

The setting for the basic power energization start angle STANGMAP by the power energization start angle calculating section 801 is explained with reference to a time chart shown in FIG. 10. The basic power energization start angle STANGMAP is equal to the power energization start angle STANG when the phase difference due to the variable valve timing mechanism is zero. Since the solenoid valve 8 of the high-pressure fuel pump 1 is the normal close type, if no force is generated to open the solenoid valve 8 up to the bottom dead center of the pump plunger (plunger 2), the solenoid valve 8 is closed and the high-pressure fuel pump 1 performs an operation for a full discharge.

Accordingly, unless the power energization start angle STANG is controlled with accuracy, unintentional pressure rising state occurs. Incidentally, if starting uniformly the power energization from the top dead center of the plunger (plunger 2) to the solenoid 200, an excessive time for electromagnetic attractive force is applied, resulting in increasing the power consumption of the solenoid 200 and heat quantity.

A force capable of opening the solenoid valve 8 is getting larger in proportion to the engine speed, and which is a force overcoming power of fluid in the pump acting in the valve closing direction. As generated the force in the solenoid valve 200 is proportional to the current, in order to open the solenoid valve, it is necessary for flowing the current over a predetermined value through the solenoid 200 until the bottom dead center of the pump plunger. The time where the current of the solenoid 200 reaches the predetermined value (current value to generate force capable of opening the solenoid valve) is dependent on the battery voltage (power source voltage) of battery 550 which is the power source for the solenoid 200; and the predetermined value (current value to generate force capable of opening solenoid valve) is proportional to the engine speed. Therefore, the basic power energization start angle STANGMAP is calculated without deficiency and excess, from the map 801 based on inputted the engine speed and battery voltage.

Additionally, there are phase variations due to mounting of the pump drive cam 100. Therefore, even when the high-pressure fuel pump 1 has the phase variation of most advancing angle side, an unintentional pressure rising state can be avoided by setting so as to flow current greater than a fixed value through the solenoid 200 until the plunger reaches to the bottom dead center (just before the start of the next discharge stroke). As setting ways to cope with such phase variations, the followings are proposed. That is, one way is that the basic power energization start angle STANGMAP previously includes a supplement thereof by the phase variation, and another way is that the power energization start angle STANGMAP is set at a predetermined center value, a correction value to the cam mounting variation is calculated separating from the STANGMAP, and then the STANGMAP is added or subtracted to calculation value of the basic power energization start angle STANGMAP.

As described above, the power energization start angle STANG is set at optimum value by considering the engine speed, battery voltage, phase difference by a variable valve timing mechanism of the pump driving cam shaft, and mounting variation of the pump driving cam 100. Thereby, the power energization to the solenoid 200 is not started uniformly from the top dead center of the pump plunger (plunger 2); and the power energization of the solenoid 200 is carried out on the way of the charging stroke of the high-pressure fuel pump 1, namely before starting the next discharging stroke after the pump plunger-reaching to the top dead center; after then the power energization is maintained to the solenoid valve 8 in valve opening state until finish of the compression stroke. As a result, power consumption and heat quantity are suppressed at minimum value and the unintentional pressure rising state occurring is avoided.

In addition, the power energization start angle STANG depends on specifications of the solenoid valve 8 and battery 550, however, it is preferable to be set at angle between after pump top dead center and at 40 degrees before next bottom dead center (conversion to the engine cam shaft angle).

Figure 11:
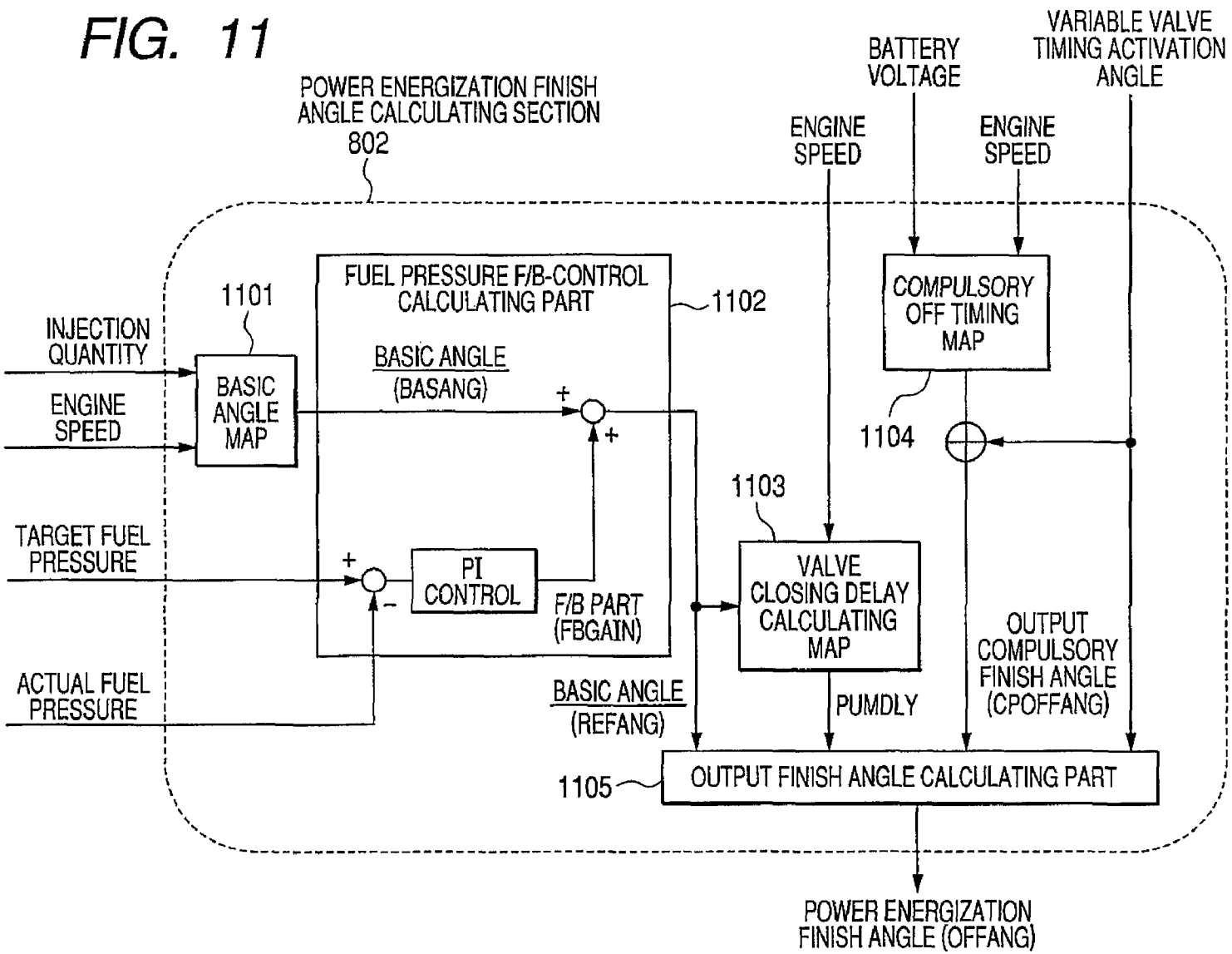
FIG. 11 is a block diagram showing detail of a power energization finish angle calculating section of the high-pressure fuel pump of the internal combustion engine according to the embodiment of the present invention.

As shown in FIG. 11, the power energization finish angle calculating section 802 includes a basic angle map 1101, a fuel pressure F/B (feedback) control calculating section 1102, a valve closing delay map 1103, a compulsory OFF timing map 1104 and an output finish angle calculating section 1105.

The power energization finish angle calculating section 802 calculates the basic angle BASANG for finish of the power energization based on a basic angle map related with the injection quantity by the injector 54 (requested fuel injection quantity) and engine speed as inputs. The basic angle BASANG sets a valve closing angle corresponding to the requested fuel discharge quantity in the stable operation state.

Figure 12:
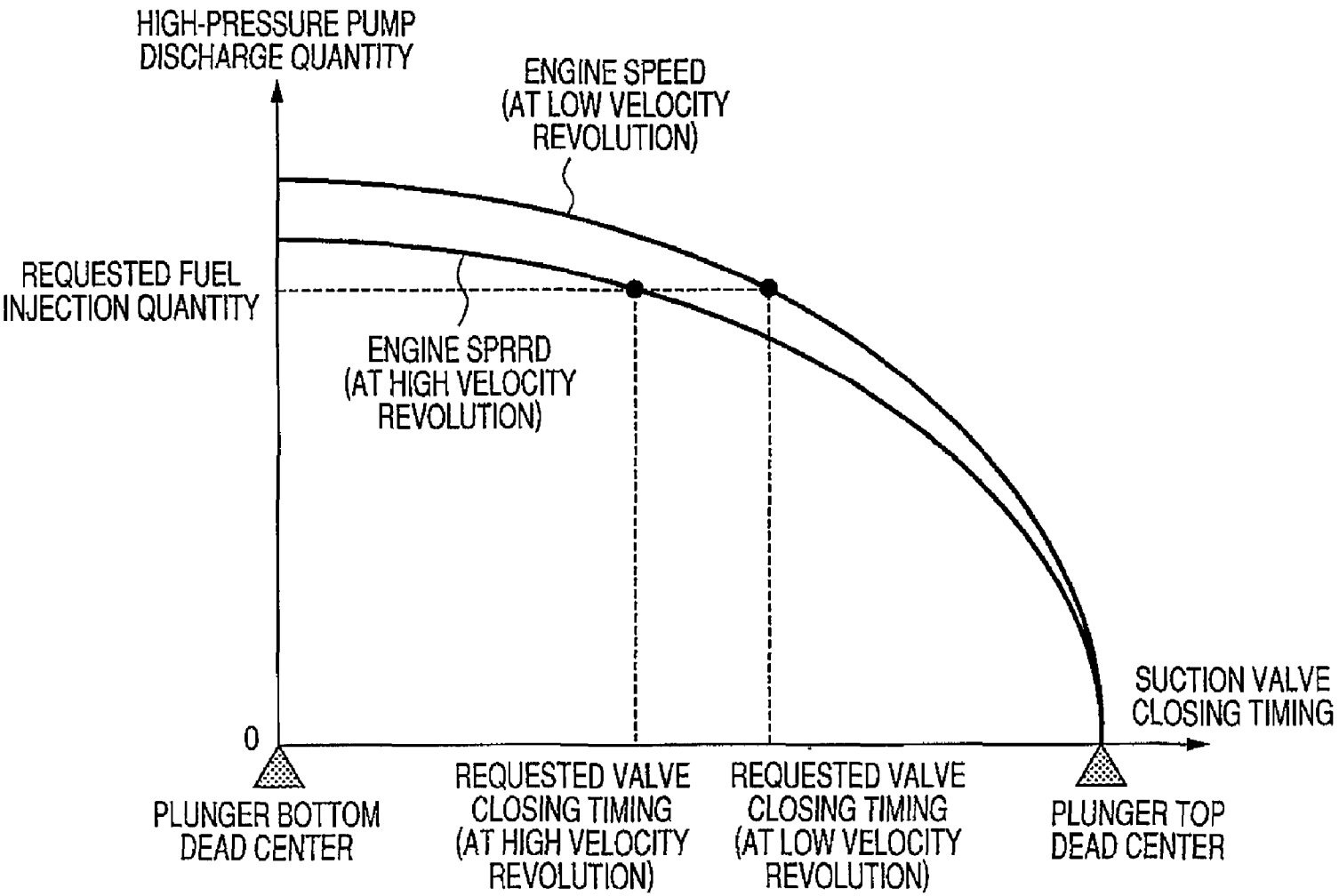
FIG. 12 is a graph showing charge quantity characteristic of the high-pressure fuel pump of the embodiment.

The setting of the basic angle BASANG is explained referring to a graph shown in FIG. 12. FIG. 12 is a graph showing the discharge rate of the high-pressure fuel pump 1 to the valve closing timing of the solenoid valve 8.

The more the valve closing timing of the solenoid valve 8 approaches the top dead center of the pump plunger, the more the high-pressure fuel pump 1 reduces the discharge quantity. The discharge rate of the high-pressure fuel pump is varied with the engine speed because discharge efficiency is different according to engine speed. Therefore, the basic angle BASANG varies with the engine speed. As a result, the basic angle BASANG varies according to the engine speed.

As described above, it is capable of improving control responsibility by obtaining the basic angle BASANG from the basic angle map 110 related with the injection quantity by the injector 54 and engine speed as inputs. The injection quantity by the injector 54 is obtainable with a higher accuracy in obtaining from an engine-intake air flow rate and a target air-fuel ratio than that of an accelerator opening degree.

A fuel pressure F/B (feed back) control computing section 1102 calculates a difference between a target fuel pressure and an actual pressure measured by the fuel pressure sensor 56, and obtains the F/B value (FBGAIN) used for PI control, and adds the F/B to the basic angle BASANG, thereby obtains a reference angle REFANG. The basic angle shows an angle which is desired to close the solenoid valve 8 from the cam reference angle (reference REFANG) in the case of assuming that there is no variable valve timing activation.

The output finish angle calculating section 105 calculates the angle OFFANG for finish of the power energization by adding and subtracting a valve closing delay PUMPDELY and an operating angle of the variable valve timing to the reference angle REFANG; wherein the valve closing delay PUMPDELY is obtained by a valve closing map 1103 related with the reference REFANG and the engine speed as inputs. The reason why the reference angle REFANG and engine speed are used for setting the valve closing delay PUMPDLY, is that a fluid pressure generated in the high-pressure fuel pump depends on the valve closing timing and the engine speed.

The power energization finish angle OFFANG calculated by the output finish angle calculating section 105 has an output compulsory finish angle CPOFFANG as utmost upper limit value. The output compulsory finish angle CPOFFANG limits the finish timing of an ON state output of the electric driving signal to a predetermined phase in the compression stroke of the high-pressure fuel pump 1; and it is obtained by adding the variable timing operating angle to a value obtained by a compulsory OFF timing map 1104 related with the engine speed and battery voltage as inputs.

Setting of the output compulsory finish angle CPOFFANG is explained with reference to the time chart shown in FIG. 13. An object of the output compulsory finish angle CPOFFANG is to stop power energization and reduce power consumption and prevent heating of the solenoid 200, by stopping the power energization in angle region where the pump becomes non-discharging even when stopping the power energization of the solenoid 200.

Figure 13:
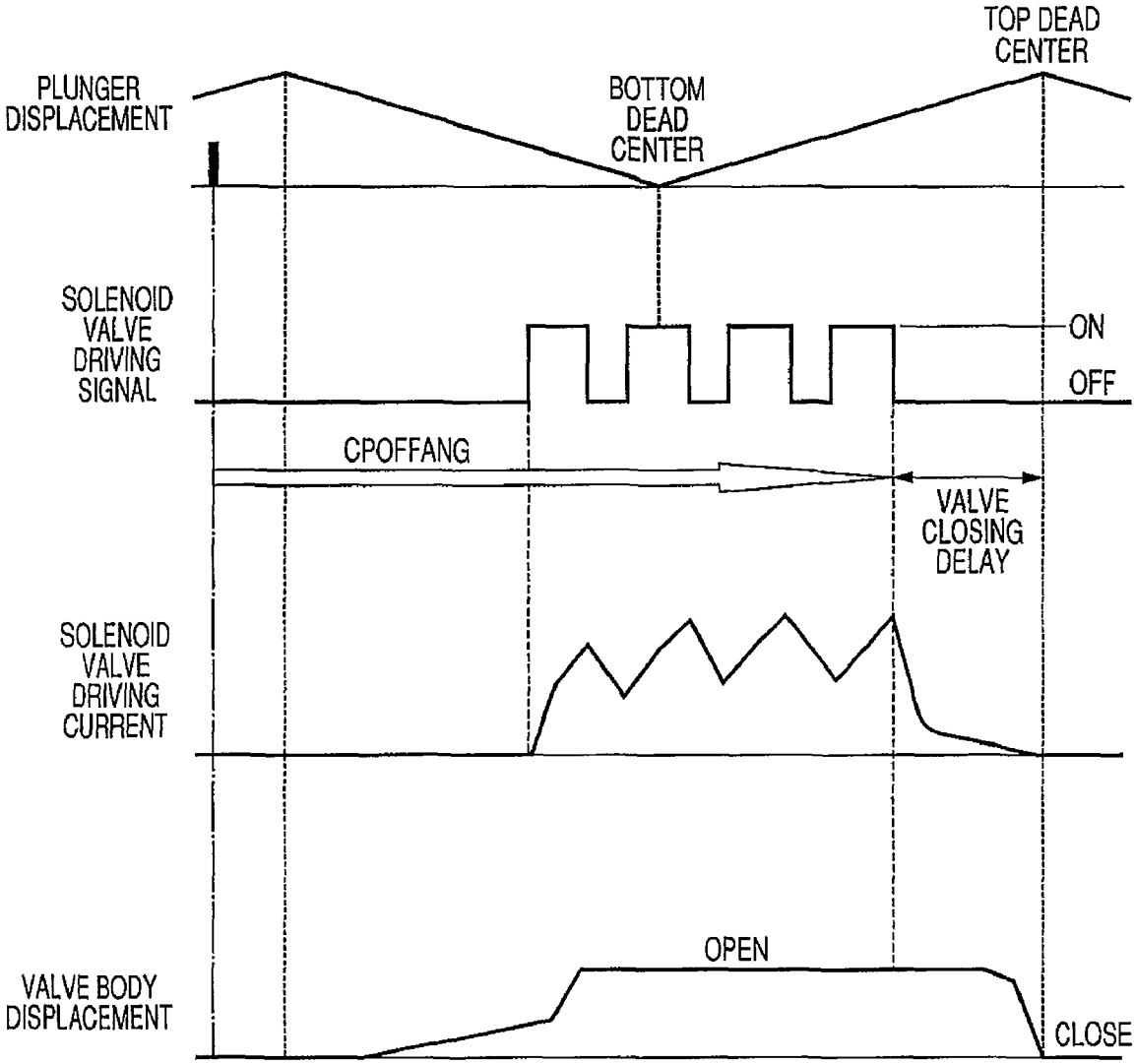
FIG. 13 is a time chart relating to setting of an output compulsory angle by the power energization finish signal calculating section according to the embodiment.

As shown in FIG. 13, even when the driving signal of the solenoid valve 8 is stopped (Of f) before the top dead center of the pump plunger, due to valve closing delay, the high-pressure fuel pump continues opening state up to near the top dead center of the pump plunger and then changes to non-discharging operation. The output compulsory finish signal CPOFFANG is used in fuel cut where non discharging operation of the pump is required and the power energization to the solenoid 200 is finished at the fuel cut angle. Accordingly, according to the above-mentioned the output compulsory finish, the power consumption can be reduced and heating of the solenoid 200 can be prevented more than that non discharging operation is made by executing full power energization control to the solenoid 200 over full period of the pump compression stroke, in the fuel cut.

The power energization finish angle OFFANG depends on specifications of the solenoid valve 8 and the battery 550, and, it is desirable to be set at an angle between 50 degrees after the pump cam bottom dead center (engine crank shaft angle conversion) and before next top dead center.

Next, an example of the pump state transition recognizing section 705 is explained with reference to a state transition view shown in FIG. 14. In the example, the A-control block comprises the A-control block 1402, the B-control block 1403, a feedback control (hereinafter referred to as F/B control block) 1404, fuel cut control block (hereinafter referred to as control under F/C control) 1405 and full discharge control block 1406.

The A-control by the A-control block 1402 is default control and, when the engine is under rotating in the starting time, the high-pressure fuel pump 1 executes the full discharge by non-power energization control.

The B-control by the B-control block 1403 prevents the discharge by equal interval power energization control to prevent excessive voltage rising before the reference REF recognition when the fuel pressure in the common rail 53 is in a high state.

F/B control by the F/B control block 1404 executes a feedback compensation control such that the fuel pressure in the common rail 53 becomes the target fuel pressure.

F/C by F/C block 1405 stops sending pressurized fuel to prevent the fuel pressure rising in the common rail 53.

When the full discharge request instruction is issued during the F/B control, the full discharge control by a full discharge control block 1406 stops the power energization to the solenoid 200 at once for full discharge state by non-power energization, and is directed to improve the responsibility of rising pressure and to reduce the power consumption of the solenoid 200.

Next, the pump state transition in the present embodiment is explained. When the ignition switch 519 changes OFF to ON and the MPU 603 of the control unit 515 becomes reset state, the solenoid 200 becomes non-power energization control state at default setting by the A-control block 1402, and a pump state variable becomes zero (PUMPD =0), the current is not supplied to the solenoid 200.

Next, a starter (not shown) becomes ON by the ignition switch 519, and the engine 507 becomes cranking state and a crank angle signal CRANK is detected. When the fuel pressure is high in the common rail 53, the condition (1) (each contents of the condition is described in detail later) is satisfied, the pump becomes an equal interval-power energization control state and is set to the pump state variable PUMPD =1.

The B-control block 1403 detects pulses of the crank angle signal CRANK, however, it does not recognize the stroke of plunger 2 as the reference REF, a plunger phase between the crank angle signal CRANK and the cam angle sensor signal is not decided. That is, in this state the timing that the plunger 2 of the high-pressure fuel pump reaches the bottom dead center position is not recognized.

When the cranking state changes from an initial period to a middle period, and the plunger phase between the crank angle signal CRANK and the cam angle sensor signal is decided and the control becomes an operation state capable of generating signal (hereinafter referred to as reference REF) which is the reference point of the phase control, the condition (3) is satisfied and it changes to the F/B control block 1404.

The F/B control block 1404 makes a pump state variable PUMPMD =2, and outputs a solenoid control signal by feedback compensation so as to coincide the actual fuel pressure calculated by the fuel pressure input processing section 701 with the target fuel pressure calculated by the target fuel pressure calculating section 702.

Figure 15:
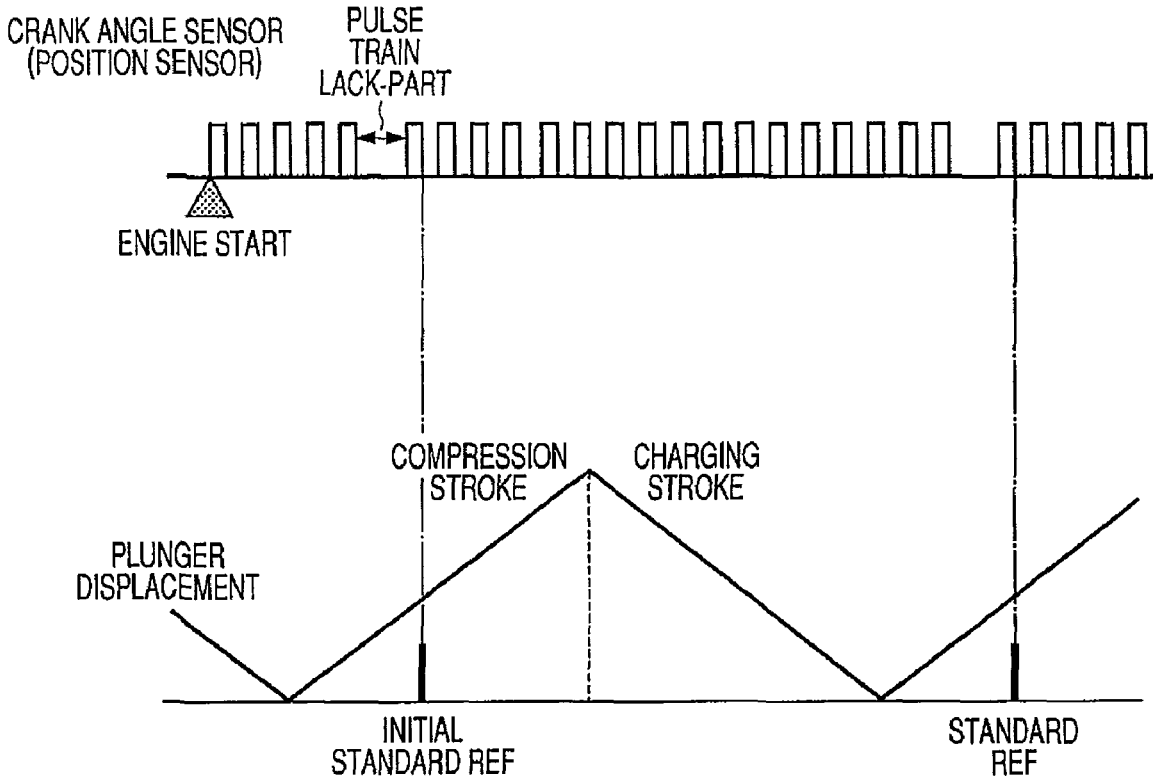
FIG. 15 is a time chart showing an example of method as to the production for Reference REF.

FIG. 15 shows an example of the reference REF generating method. The crank angle sensor signal CRANK includes a pulse lack part in pulse train. The crank angle sensor signal CRANK at the time when the first pulse lack part is detected from engine start is set to the reference REF, after that, the reference REF are generated from crank angle sensor value in every constant rotational angle. The recognition of the pulse lack part is recognized based on the input interval of the crank angle sensor signal.

When the plunge phase is not decided and no reference REF is generated, the condition (2) is satisfied and changes to the A-control by the A-control block 1402. Also, when the starter switch 520 turns ON and the engine 507 is in a ranking state and the fuel pressure in the common rail 53 becomes low, the plunger phase between the crank angle sensor signal CRANK and the cam angle sensor signal CAM is decided. In this case, the A-control is performed until the reference REF is generated, thereby the increasing fuel pressure in the common rail 53 is promoted, and after the condition (4) is satisfied, the control changes to the F/B control by the F/B control block 1404.

After that, as long as no engine stall generates, the F/B control by the F/B control block 1404 continues. When the fuel cut is performed due to speed reduction and the like, fuel injection by the fuel injector 54 is not performed and the fuel quantity from the common rail 53 is not reduced. Therefore, condition (5) is satisfied, the system changes to the control in the F/C by F/C control block 1405 and set a pump state variable PUMPMD=3 and the pressurized fuel fed to the common rail 53 from high-pressure pump 1 is stopped. Additionally, if under F/C control, condition 6 is satisfied by the end of the fuel cut, the control changes to the F/B control by the F/B control block 1404 and returns to the normal feedback control by the F/B control block 1404.

When necessary for pressure rising during the F/B control and full discharge request is issued, condition (8) is satisfied and the control changes to full discharge control by full discharge control block 1406 and sets a pump state variable PUMPMD=4, and non-power energization to the solenoid 200 is carried out. Under full discharge control, if condition 9 is satisfied by end of full discharge request, the control changes to the F/B control by the F/B control block 1404, and returns to the normal feedback control by the F/B control block 1404.

If the engine stall causes in the F/B the control or F/C control, the condition (7) is satisfied and the system changes to the A-control by the A-control block 1402.

Figure 16:
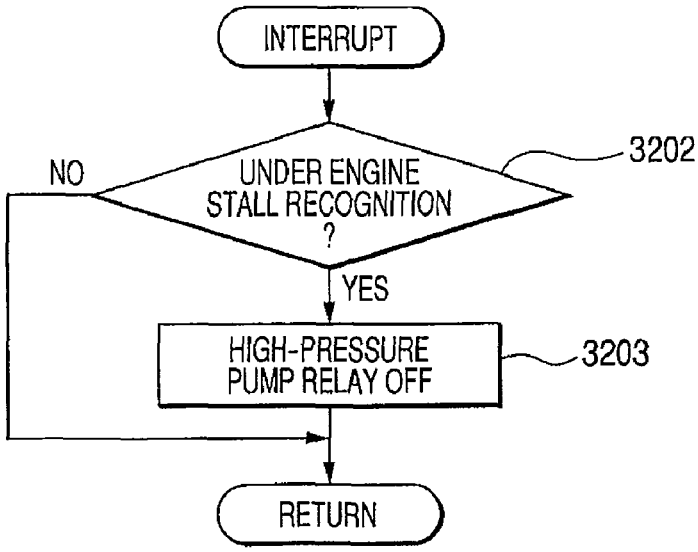
FIG. 16 is a flow chart showing a high-pressure pump power source of the high-pressure pump control apparatus in the internal combustion engine.

The A-control flow chart where the high-pressure fuel pump power source (relay) is turned OFF is explained with reference to FIG. 16. When the high-pressure pump source is OFF, no current flows through the solenoid 200 even if outputting the pump-driving signal from the control unit 415.

When the power source of the normal close type pump (high-pressure fuel pump 1) is co-connected with the ignition switch 519, the ignition switch 519 during engine rotating is tuned OFF, the full discharge is continued until the engine rotation stoppage, and unintentional pressure increase may occur. To avoid this, the power source of the high-pressure fuel pump is separated system from the ignition switch 519, and after recognition of engine install (step 3202), the power source of high-pressure fuel pump 1 is cut off. (step 3203).

Figure 17:
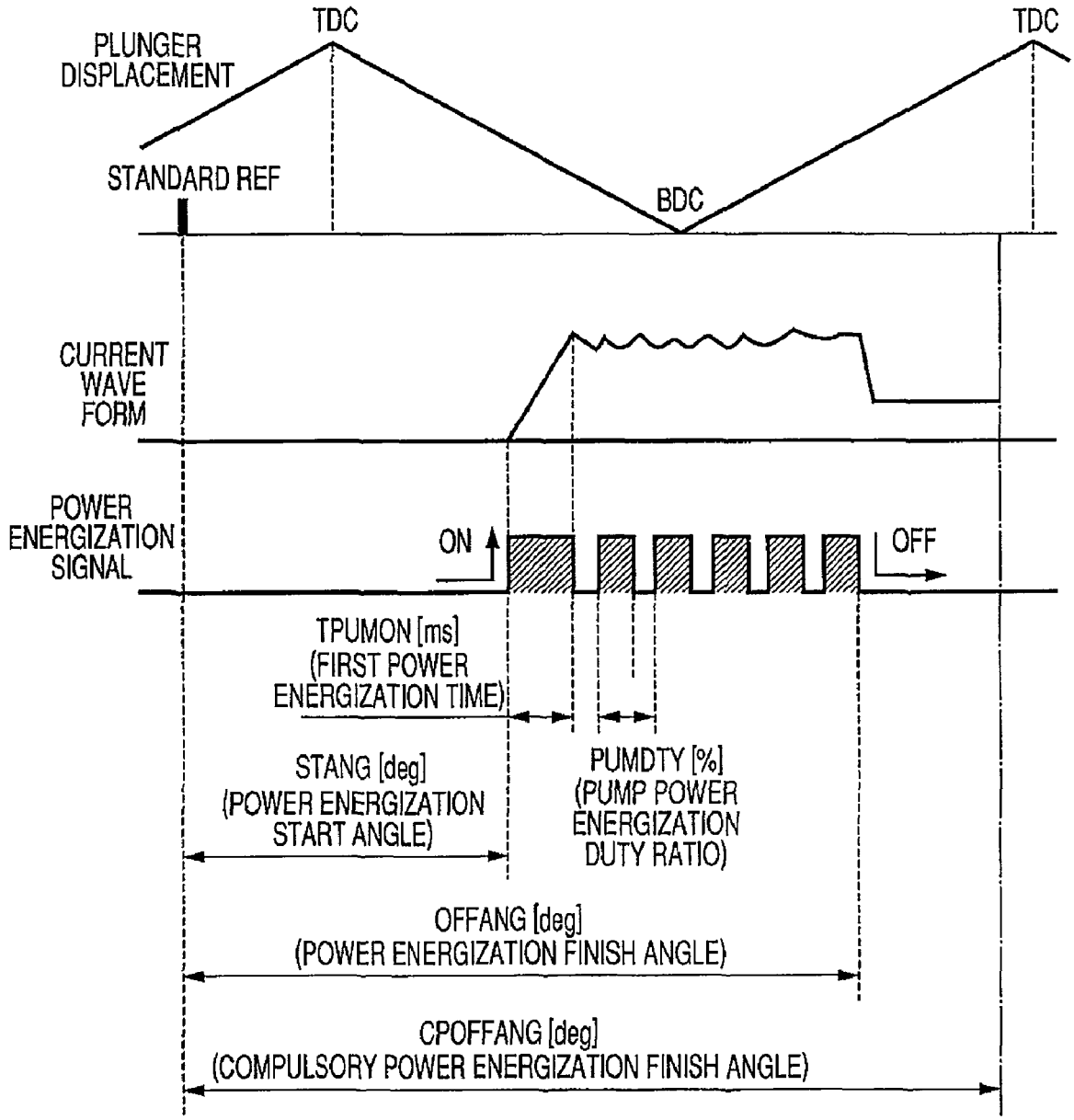
FIG. 17 is a time chart showing an example of the solenoid power energization control under feedback control by the high-pressure fuel pump control apparatus of the internal engine according to the embodiment.

The power energization of the solenoid 200 under the control of F/B is explained referring to the time chart illustrated in FIG. 17.

An open current control duty is output from the power energization start signal STANG to the power energization finish angle OFFANG. The open current duty consists of an initial power energization time TPUMPON and a duty ratio PUMPTY after the initial power energization. That is, for the first time, the continuous power energization signal (ON signal) is output over initial power energization time TPUMPON and after that, the duty signal is output. The initial power energization time TPUMPON and the duty ratio PUMPDTY after the initial power energization is calculated by the pump control duty calculating means 704 (refer to FIG. 17).

Figure 18:
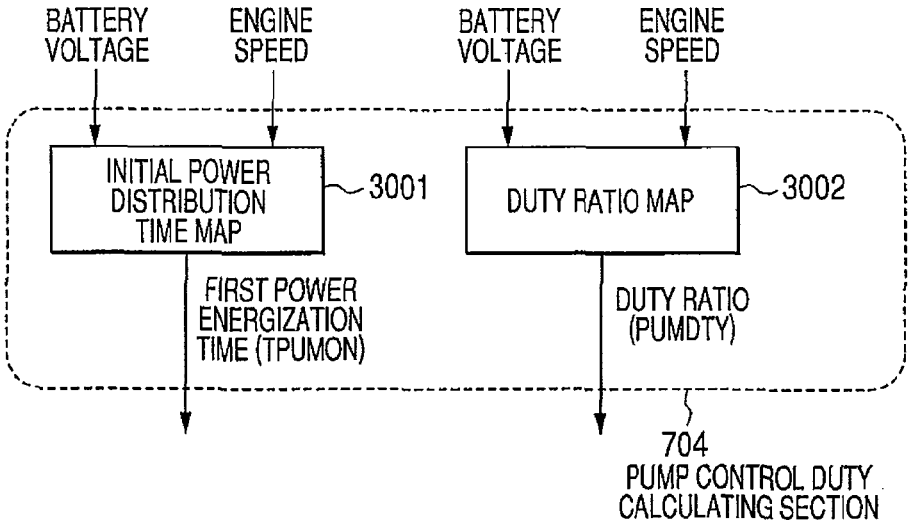
FIG. 18 is a block diagram showing detail of a pump control duty calculating section of the high-pressure fuel pump control apparatus of the internal combustion engine according to the embodiment of the present invention.

The pump control duty calculating section 704 is explained in detail with reference to FIG. 18. The pump control duty calculating section 704 sets the initial power energization time TPUMPON by using initial power energization map 3001 related with the engine speed and the battery voltage as inputs. The initial power energization time TOUMOON has an object to reach a current value capable of making the solenoid valve open value. As is different on fluid power generated in the high-pressure fuel pump 1 according to the engine speed, it is calculated based on the initial energization time map 3001 related with the engine speed and the battery voltage as inputs.

Figure 19:
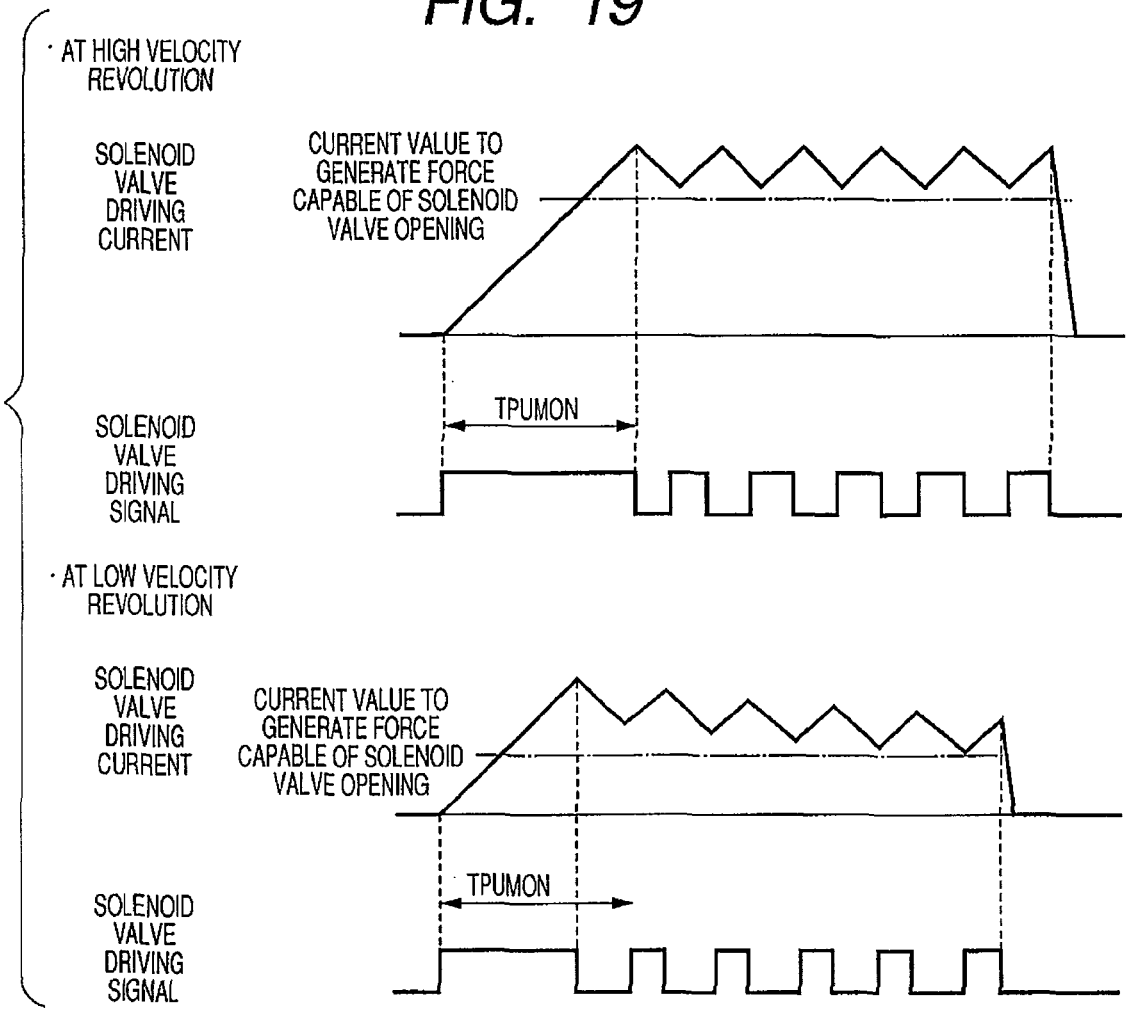
FIG. 19 is a time chart relating to setting of the initial power energization time of the internal combustion engine when the battery voltage is constant.

As shown in FIG. 19, since the fluid force in the direction of valve closing in the compression stroke increases according to increase of the engine speed and consequently, the current value capable of opening solenoid valve 8 as the suction valve becomes larger, the initial power energization time TPUMPON to the engine speed at constant battery voltage is set at larger value according to increase of the engine speed.

When enabling to separately set the initial power energization time TPUMPON and considering the mounting variations of the pump driving cam 100, if ON time of the TPUMPON is set to larger in comparison with ON time of the later half-duty control, a sure valve opening operation is realized in the compression stroke. Further, by considering the worst conditions on the engine speed or battery voltage, a map for setting initial power energization time TPUMPON is capable of being changed into a table related with the engine speed and the battery voltage as inputs.

A pump control duty calculating section 704 sets the duty ratio PUMPDTY by using DUTY ratio map 3002 related with the engine speed and the battery voltage as inputs. A duty ratio signal with the duty ratio PUMPDTY is used to the latter half part of solenoid valve driving signal. The reason is, in addition to reduce a heating quantity of the solenoid 200, to suppress an upper limit of the current flowing through the solenoid 200 in order to hasten an attenuation of the current flowing through the solenoid at energizing OFF. Therefore, by hastening the current attenuation, it is possible to shorten the valve opening response time and to improve the discharge accuracy. Thereby it is possible to improve the high velocity revolution of the pump.

As fluid force produced in the high-pressure fuel pump varies in accordance with the engine speed, the duty ratio PUMPDTY is calculated based on the duty ratio map 3002 related with the engine speed and battery voltage as inputs. The higher the engine speed, the fluid force toward valve closing direction in the pump compression stroke increases. Therefore, the higher the engine speed, increasing an ON time part of the duty ratio signal for the high-pressure pump and keeping the high current value, so that an unintentional valve closing motion of the solenoid valve as the charging valve can be avoided.

Figure 20:
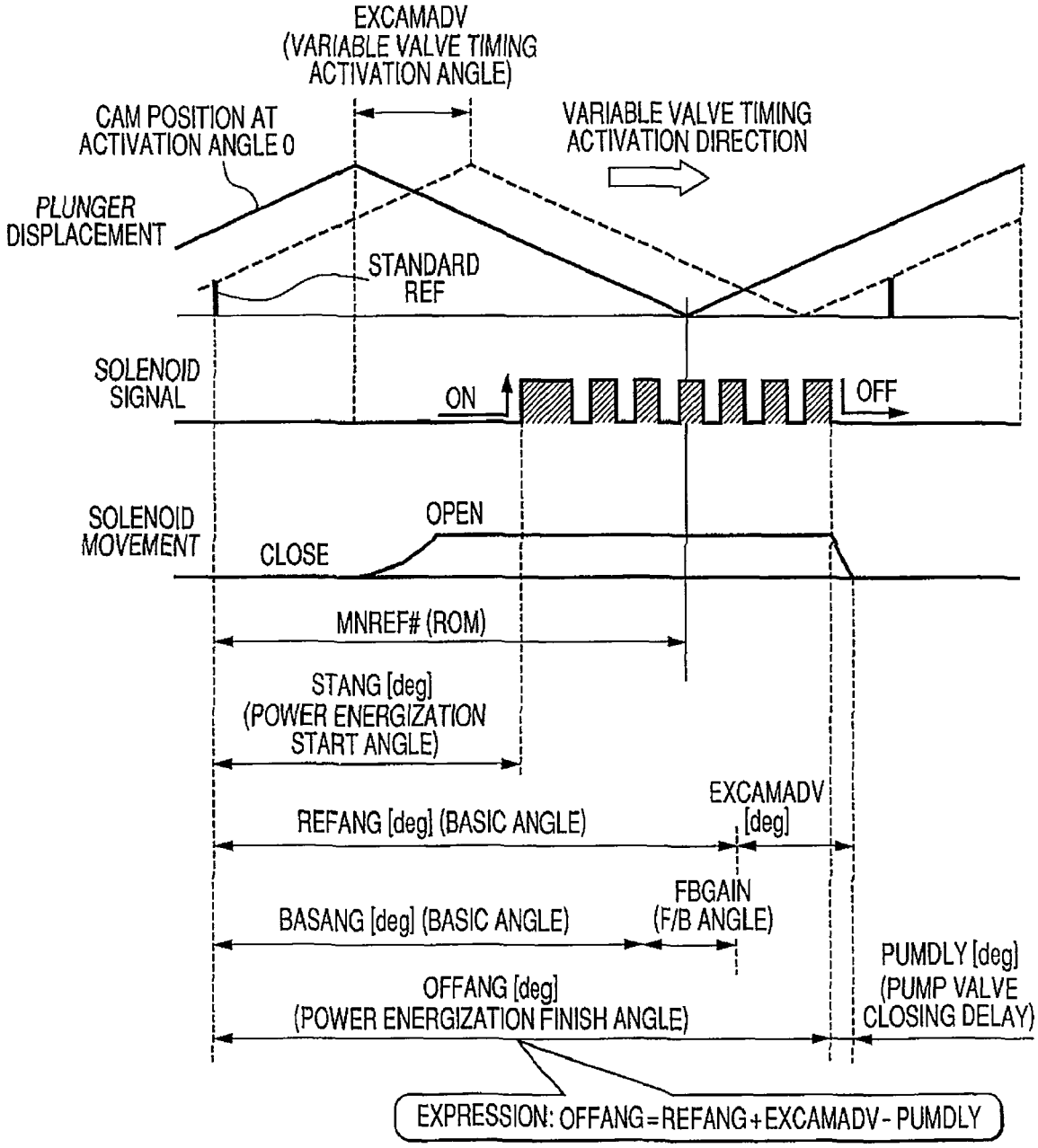
FIG. 20 is a time chart showing fuel control system control by the high-pressure fuel pump control apparatus of the internal combustion engine.

The calculation as to the power energization start angle STANG and the power energization finish angle OFFANG of the solenoid signal used for the fuel pressure control by the control unit 515, and each parameter used in the calculation are explained with reference to FIG. 20.

The power energization start angle STANG and the power energization finish angle OFFANG of the solenoid signal are set from the reference REF caused on the basis of the crank signal and the cam signal and the stroke of the plunger 2.

As explained with reference to FIG. 9, the power energization start angle STANG is calculated by correcting the map value related with the engine speed and the battery voltage, using the phase difference due to the variable timing mechanism of the pump driving cam as correction value.

The power energization finish angle OFFANG is obtainable by equation (1).

$$OFFANG=REFANG+EXCAMADV-PUMPDLY \quad (1)$$

Here, REFANG is the reference angle, EXCAMADV is a cam operating angle, and PUMDLY is pump delay angle. The cam operating angle EXCAMADV corresponds to the variable valve timing activation angle.

The reference angle REFANG is obtainable by the equation (2).

$$REFANG=BASANG+FBGAIN$$

Here, BASANG is a basic angle and FBGAIN is feedback part.

The basic angle BASANG is obtained from the basic angle map 1100 (refer to FIG. 11) based on the operation state of the engine 507A.

Next, A state transition recognition processing of the engine 507 in a state transition recognizing (conditions 1 to 9 in FIGS. 1 to 9) section 707 is explained referring to flow charts of FIGS. 21 to 29. Additionally, each state recognition processing is executed at every predetermined time period, for example, time period of 10 ms as interrupt routines.

(A-Control→B-Control)

Figure 14:
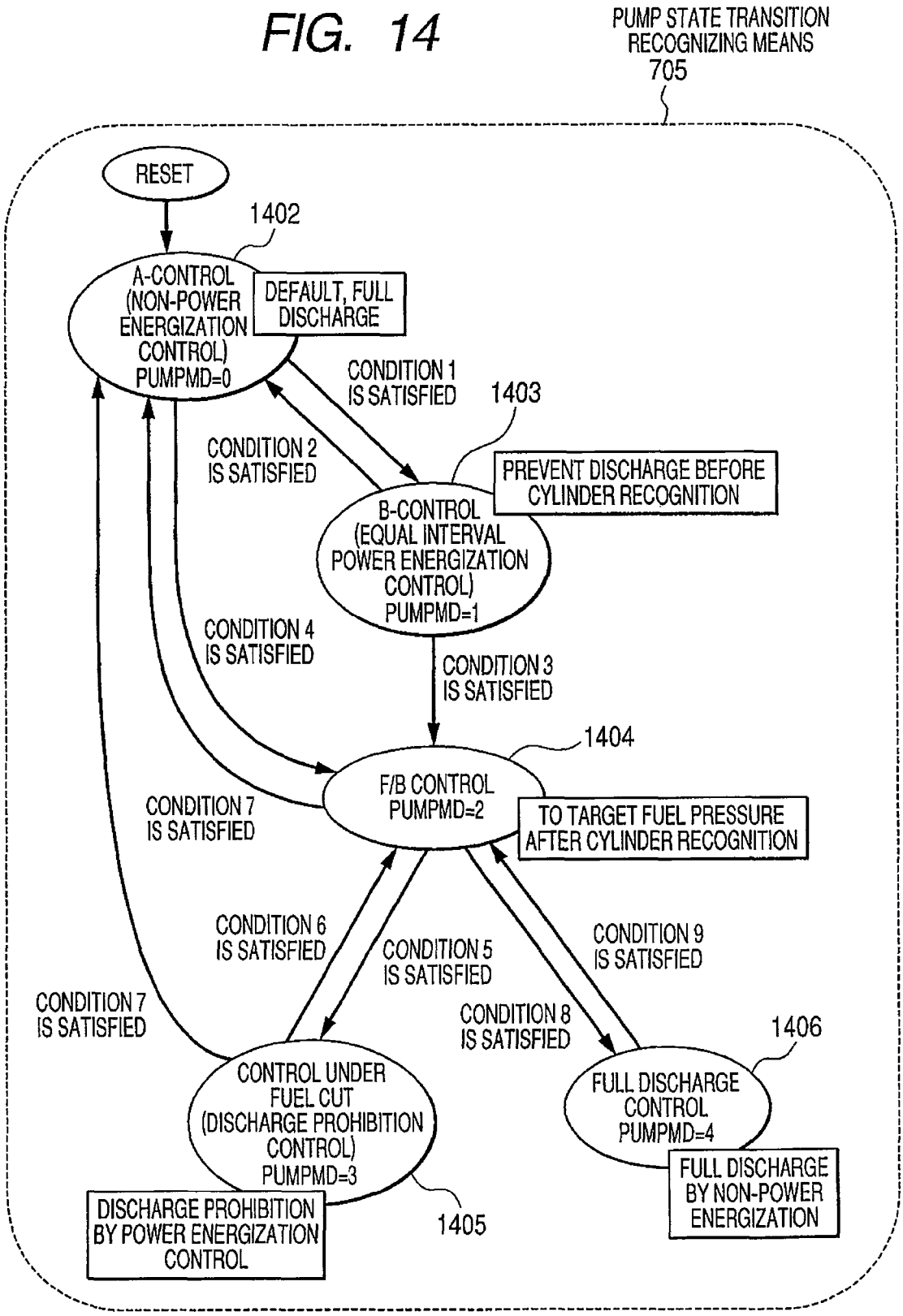
FIG. 14 is a state transition view showing an embodiment of pump state transition of the high-pressure fuel pump control apparatus of the internal combustion engine according to the embodiment.
Figure 21:
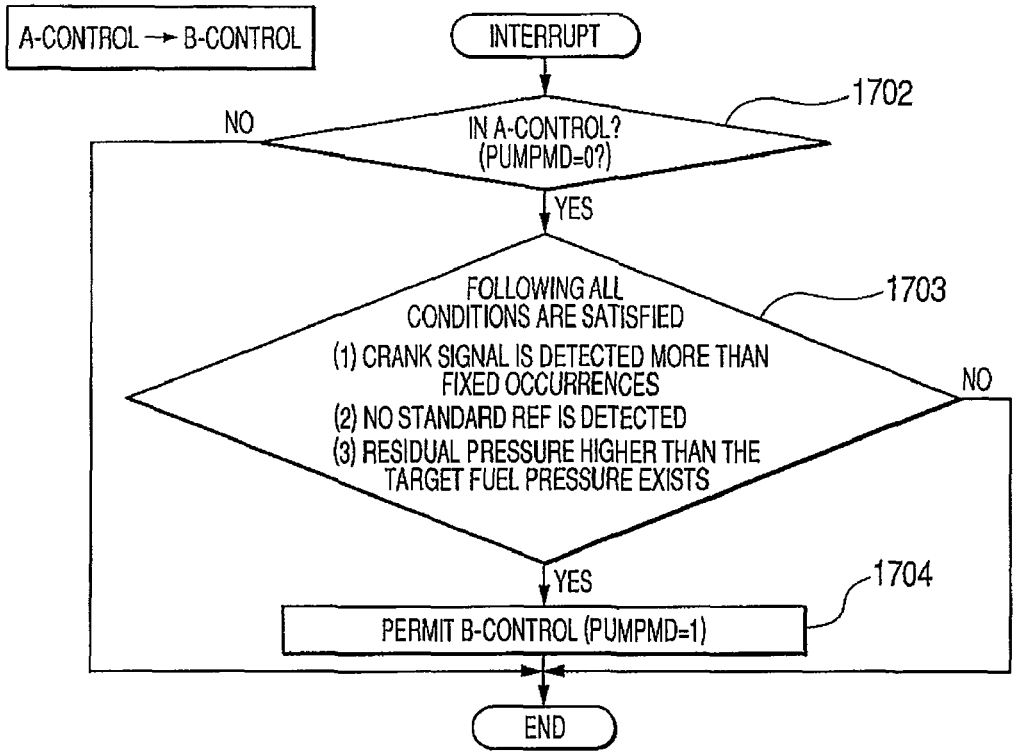
FIG. 21 is a flow chart of transient recognition processing from A-control to B-control at condition (1) by the embodiment.

FIG. 21 is a flow chart of the transient recognizing processing from the A-control into the B-control when the condition (1) shown in FIG. 14 is satisfied. For the first time, at step 1702, the pump state variable PUMPMD is read out and recognized whether the control is in the A-control or not. When being in the A-control, the routine goes to step 1703 and recognizes whether the B-control permission condition is satisfied or not.

The B-control permission is selected when no reference REF is recognized and the phase control is inoperable, and when the pressure rising is not necessary because the fuel pressure in the common rail 53 is higher than the target fuel pressure thereof. A condition of the crank angle is a condition for recognizing the cranking state at start.

When now is not in the A-control, or the B-control permission condition is not satisfied, this routine is finished at once. In contrast to this, when the B-control permission condition is satisfied, the routine goes to step 1704 and permits the B-control, and then this routine finishes.

(B-Control→A-Control)

Figure 22:
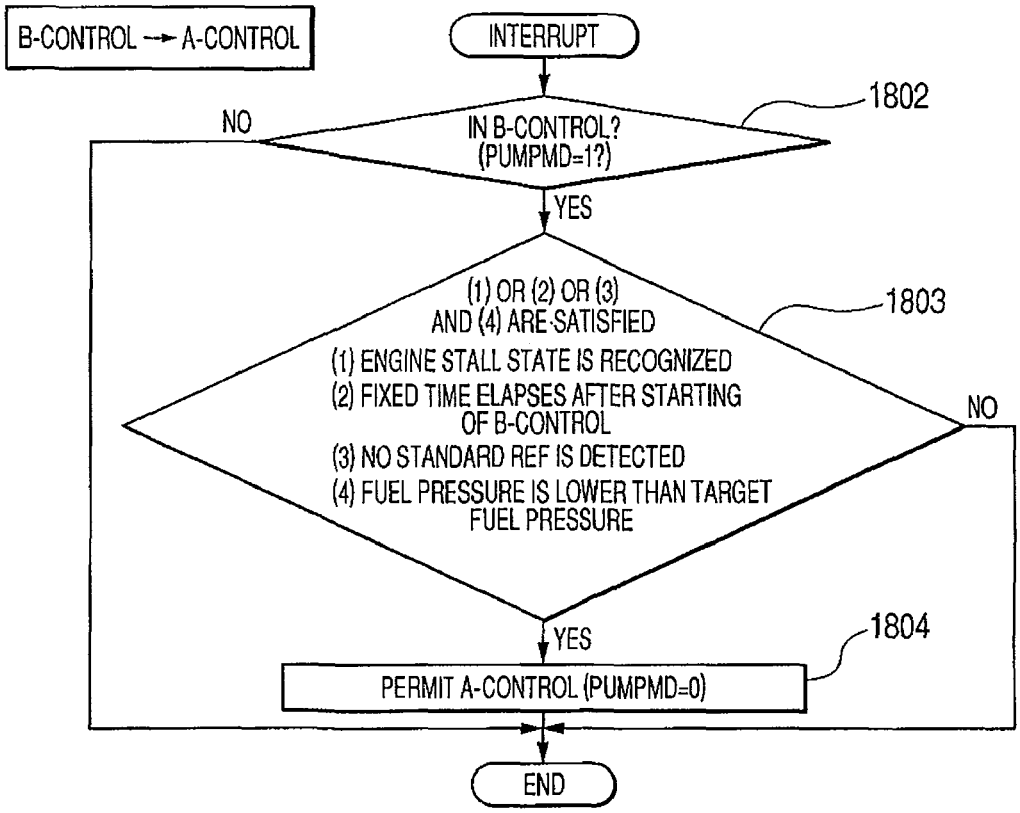
FIG. 22 is a flow chart of transient recognition processing from the B-control to the A-control at condition (2) in the embodiment.

FIG. 22 is a flow chart of the transition recognizing processing from the B-control to the A-control when being in the condition (2) in FIG. 14. First, in step 1802, whether the control is in the B-control or not is recognized by reading the pump state variable PUMPMD. When being in the B-control, the routine goes to step 1803 and recognizes whether the A-control permit condition is satisfied or not.

A condition where the A-control is selected in the B-control is as follows. One is the case where the B-control is stopped because the control although is in the B-control, the reference REF has not been produced during the predetermined lapse time. Another is the case where the B-control is finished because the request of the pressure raising is issued.

When now is not in the B-control, or the A-control permit condition is not satisfied, this routine is finished at once. In contrast to this, when the A-control permission condition is satisfied, the routine goes to step 1804 and permits the A-control, and then this routine finishes.

(B-Control→F/B Control)

Figure 23:
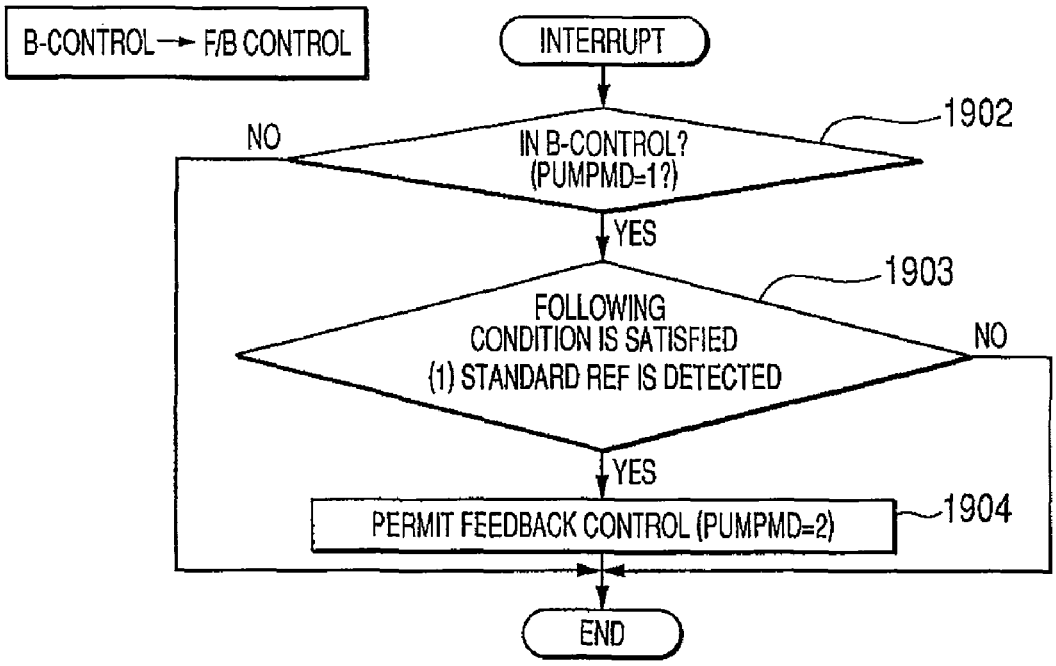
FIG. 23 is a flow chart of transient recognition processing from the B-control to F/B control at condition (3) in the embodiment.

FIG. 23 is a flow chart of the transient recognizing processing from the B-control to the F/B control when the condition (3) shown in FIG. 14 is satisfied. For the first time, at step 1902, the pump state variable PUMPMD is read out and the routine recognizes whether the control is in the B-control or not. When now is in the B-control, the routine goes to step 1903 and recognizes whether the reference REF is produced or not.

When the reference REF is produced, as the F/B control becomes possible to perform, the routine goes to step 1904 and permit the F/B control, and then this routine finishes. When the B-control is not performed, or the reference REF is not produced, this routine is finished at once.

(A-Control→F/B-Control)

Figure 24:
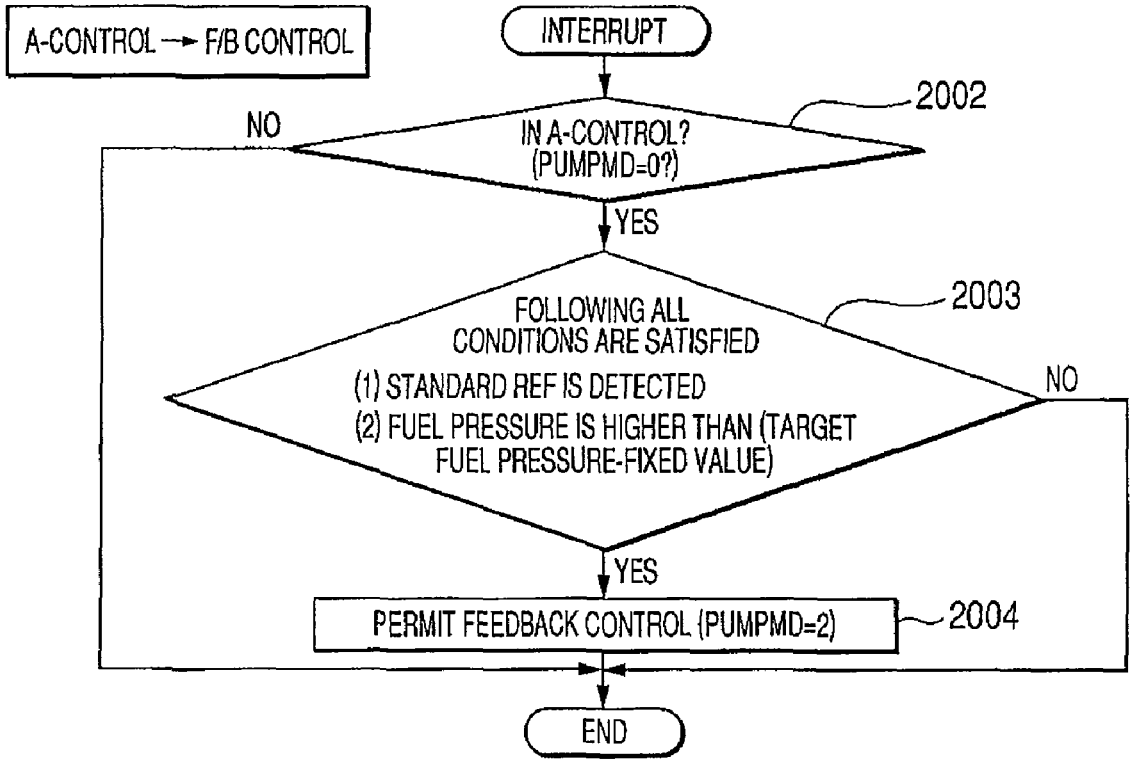
FIG. 24 is a flow chart of transient recognition processing from A-control to F/B control at condition (4) in the embodiment.

FIG. 24 is a flow chart of the transient recognizing processing from the A-control to the F/B-control when the condition (4) shown in FIG. 14 is satisfied. Firstly, at step 2002, the pump state variable PUMPMD is read out and the routine recognizes whether the control is in the A-control or not. When being in the A-control, the routine goes to step 2003 and recognizes whether the F/B control permission condition is satisfied or not.

A condition where the F/B control permission is selected in the A-control, is that the reference REF is produced and when the fuel pressure in the common rail 53 is going to converge to the target fuel pressure. However even when the reference REF is produced, if the fuel pressure in the common rail 53 is considerably lower in comparison with the target fuel pressure, the F/B control is not permitted because continuous control of the A-control is able to promote to raise the fuel pressure.

When now is not in the A-control, or the F/B control permission condition is not satisfied, this routine is finished at once. In contrast to this, when the F/B control permission condition is satisfied, the routine goes to step 2004 and permits the F/B control, and then this routine finishes.

Figure 30:
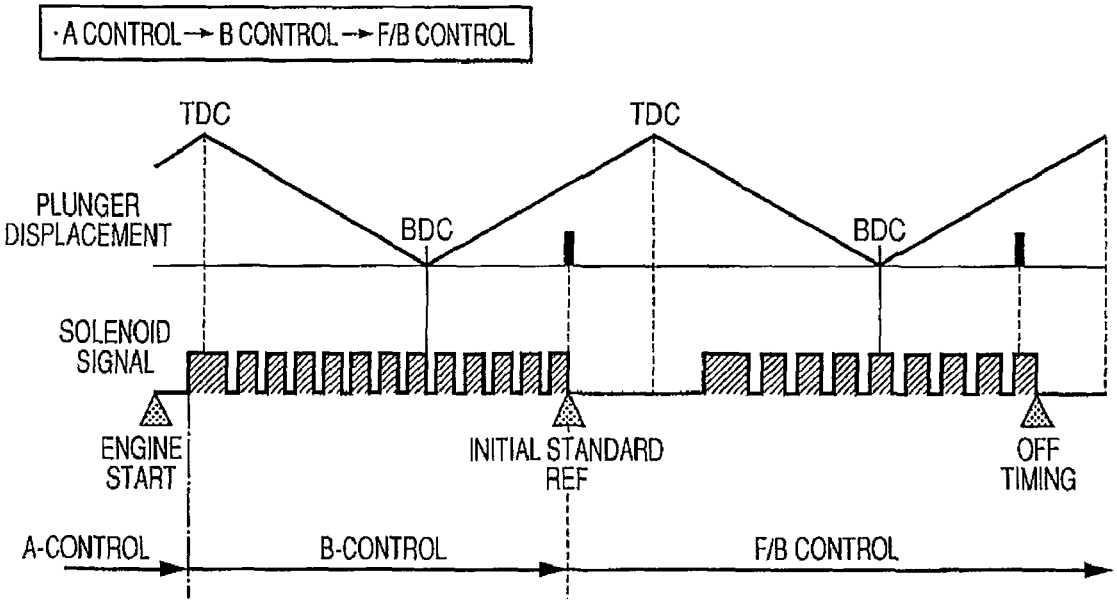
FIG. 30 is a time chart of transient recognition processing A-control→B-control→F/B control in the embodiment.
Figure 31:
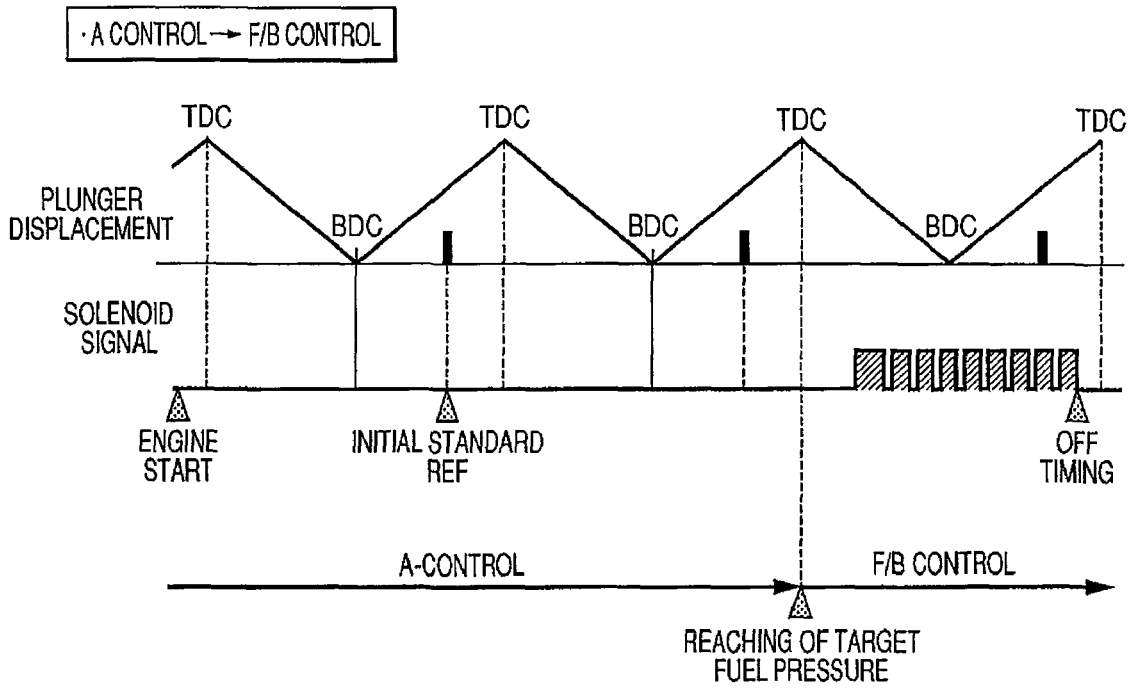
FIG. 31 is a time chart of transient from the A-control to F/B control in the embodiment.

FIG. 30 is a time chart at the time when a transition of the A-control→the B-control→F/B control is carried out. FIG. 31 is a time chart at the time when a transition of the A-control→F/B control. FIG. 30 shows that a power energization for the solenoid 200 starts from just after cranking when the fuel pressure in the common rail 53 is higher than the target fuel pressure. FIG. 31 shows that, when the fuel pressure in the common rail 53 is lower than the target fuel pressure, the power energization for solenoid 200 starts after the fuel pressure reaches the target pressure. Therefore, it is capable of realizing optimum fuel pressure behaviors at the start, and improving emission gas properties at starting.

(F/B Controls Control in F/C)

Figure 25:
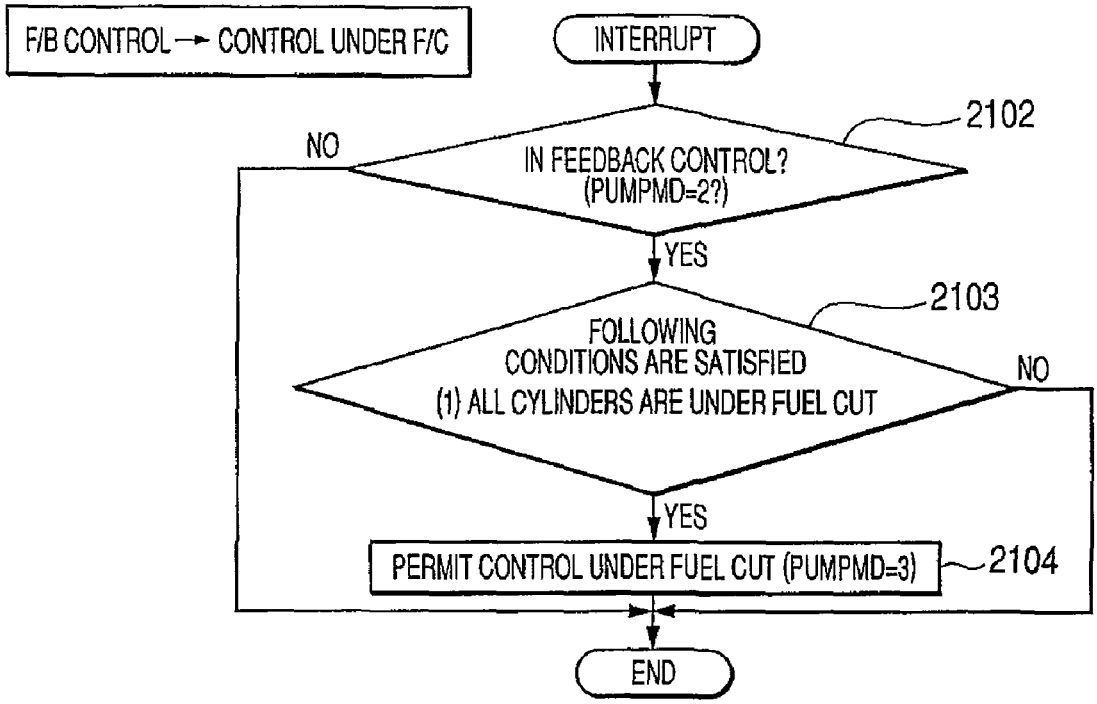
FIG. 25 is a flow chart of transient recognition processing from F/B control to F/C control at condition (5) in the embodiment.

FIG. 25 is a flow chart of the transient recognizing processing from the F/B-control to the F/C control when the condition (5) shown in FIG. 14 is satisfied. For the first time, at step 2102, the pump state variable PUMPMD is read out and the routine recognizes whether the control is in F/B control or not. When now is in the F/B control, the routine goes to step 2103 and recognizes whether the F/C control permission condition is satisfied or not.

The F/C control permission condition is that all cylinders of the combustion engine are in the F/C control, when the F/C control permission condition is satisfied, the routine goes to step 2104, the F/C control is permitted, after that, the routine is finished. Incidentally, now is not in the F/B control or the F/C control permit condition is not satisfied, the routine is finished at once.

(Control in F/C→F/B Control)

Figure 26:
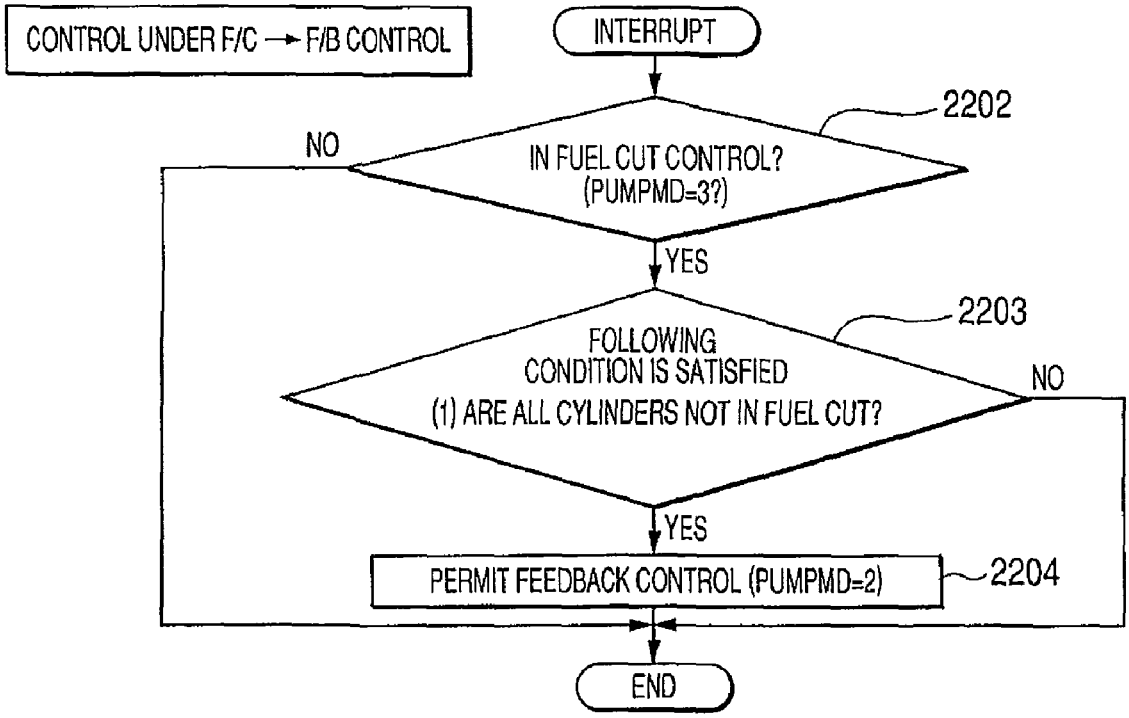
FIG. 26 is a flow chart of transient recognition processing from control under F/C to F/B control at condition (6) in the embodiment.

FIG. 26 is a flow chart of the transient recognizing processing from the F/C control to the F/B control when the condition (6) shown in FIG. 14 is satisfied. For the first time, at step 2202, a pump state variable PUMPMD is read out and the routine recognizes whether the control is in the control under F/C or not. When now is in the F/C control, the routine goes to step 2203, and the routine recognizes whether the F/C control permission condition is satisfied or not.

Here, the condition of F/C control permission is that all cylinders are not in the fuel cut. When the fuel cut of all cylinders are finished and the F/B control permission conditions are satisfied, the routine goes to step 2204, the F/B control is permitted, and then this routine finishes. Incidentally, when now is not in the F/C control or the F/B control permission conditions are not satisfied, the routine finishes at once.

(Control Under F/C, F/B Control→A-Control)

Figure 27:
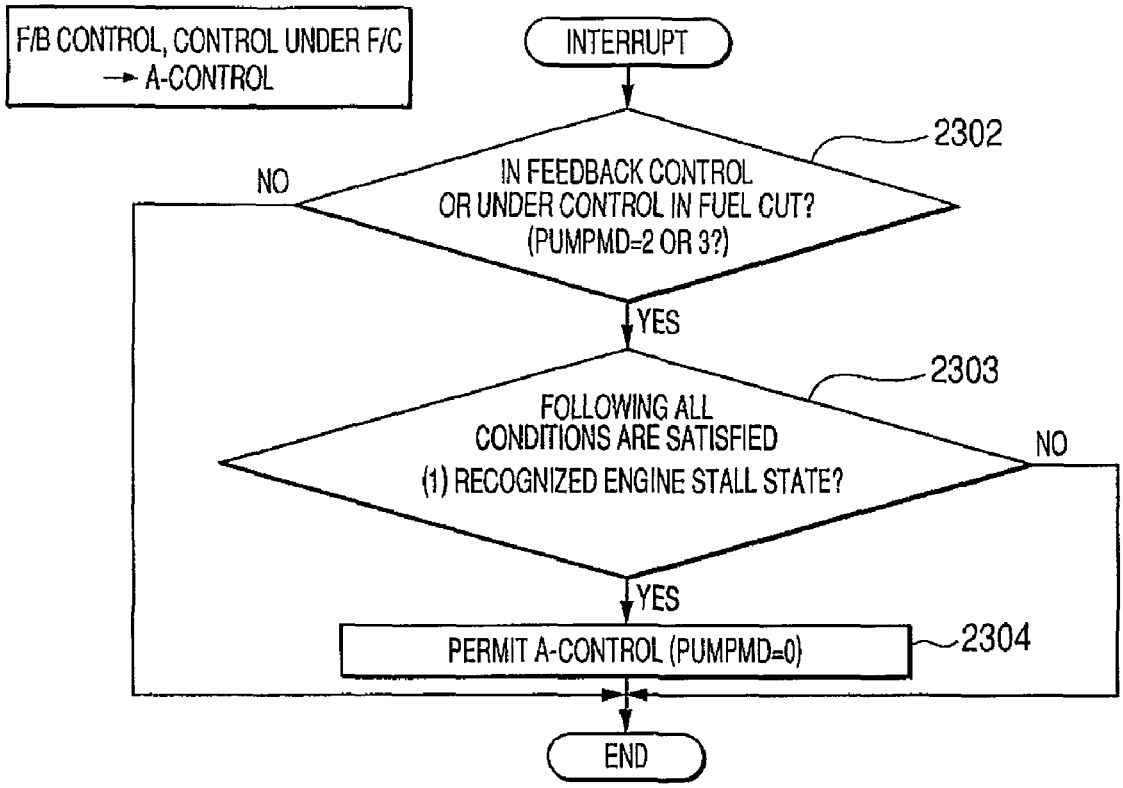
FIG. 27 is a flow chart of transient recognition processing from control under F/C or F/B-control to the A-control at condition (7) in the embodiment.

FIG. 27 is a flow chart of the transition recognizing processing under the F/C control or from the F/B control when the condition (7) shown in FIG. 14 is satisfied. Firstly, in step 2302, whether control is in the F/B or F/C control or not is recognized by reading out the pump state variable PUMPMD. When now is in the F/B control or in the F/C control, the routine goes to step 2303 and recognizes whether the A-control permission condition is satisfied or not.

Here, the A-control permission condition is whether an engine stall state is satisfied or not. When the A-control permission condition is satisfied, the routine goes to step 2304 to stop the pump control, the A-control is permitted, and then the routine finishes. Incidentally, when now is in neither the F/B control or F/C control, or when the A-control permission condition is satisfied, the routine finishes at once.

(F/B Control→Full Discharge Control)

Figure 28:
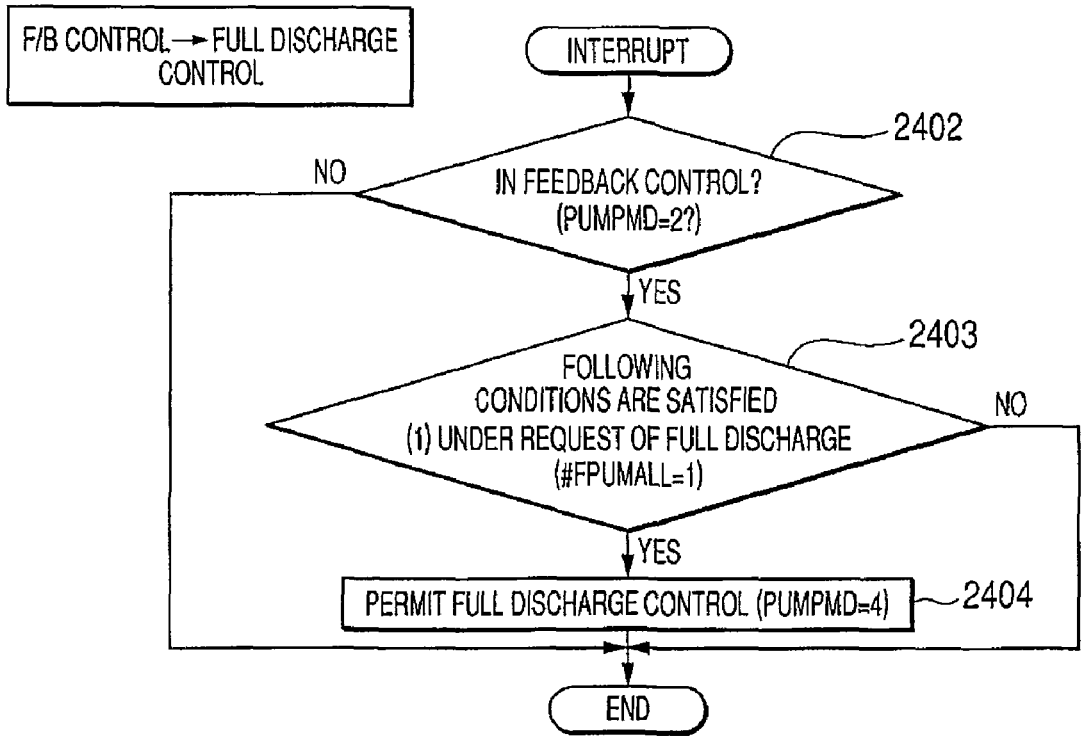
FIG. 28 is a flow chart of transient recognition processing from F/B control to full discharge control at condition (8) in the embodiment.

FIG. 28 is a flow chart of the transition recognizing processing from F/B control to the full discharge control when the condition (8) in FIG. 14 is satisfied. Firstly, in step 2402, whether the control is in the F/B control is or not is recognized by reading out the pump state variable PUMPMD. When now is in the F/B control, the routine goes to step 2403 and recognizes whether the full discharge is requested or not by reading out the full discharge request flag #FPUMALL.

When full discharge is requested, the routine goes to step 2404 and permits the full discharge control, and then the routine finishes. In contrast to this, when now is not in the F/B control or the full discharge is not requested, this routine finishes at once.

Next, setting of the full discharge request flag #FPUMPALL is explained with reference to a flow chart shown in FIG. 32. The full discharge request flag #FPUMPALL is to flag when a discharge quantity near full discharge of the high-pressure fuel pump 1 is requested by the control unit 515.

Figure 32:
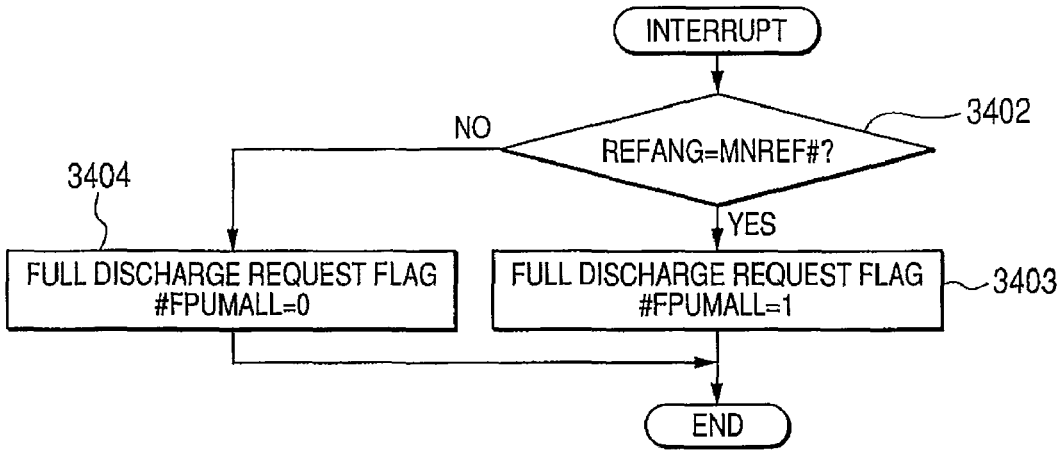
FIG. 32 is a flow chart of setting processing of request flag of full discharge.

The full discharge request flag setting routine as shown in FIG. 32 is interrupt processing too, and for example, it is read out at every 10 ms. Firstly, at the step 3402, the routine recognizes whether REFANG=MNREF# or not. Here REFANG shows an angle requested for closing the solenoid valve 8 from the reference REF. MNREF# shows an angle up to the bottom dead center of the plunger from the reference REF when no variable valve timing action. (See FIG. 20)

Therefore, when REFANG=MNREF#, the full discharge is requested because of requesting closing of the solenoid valve 8 at bottom dead center of the plunger.

When being REFANG=MNREF#, the routine goes to step 3403 and finishes after setting the full discharge request flag # FUMPALL=1. In contrast to this, when the REFANG=MNREF# is not satisfied, the routine goes to step 3404 and finishes after setting the full discharge request flag #FPUMPALL=0.

Figure 33:
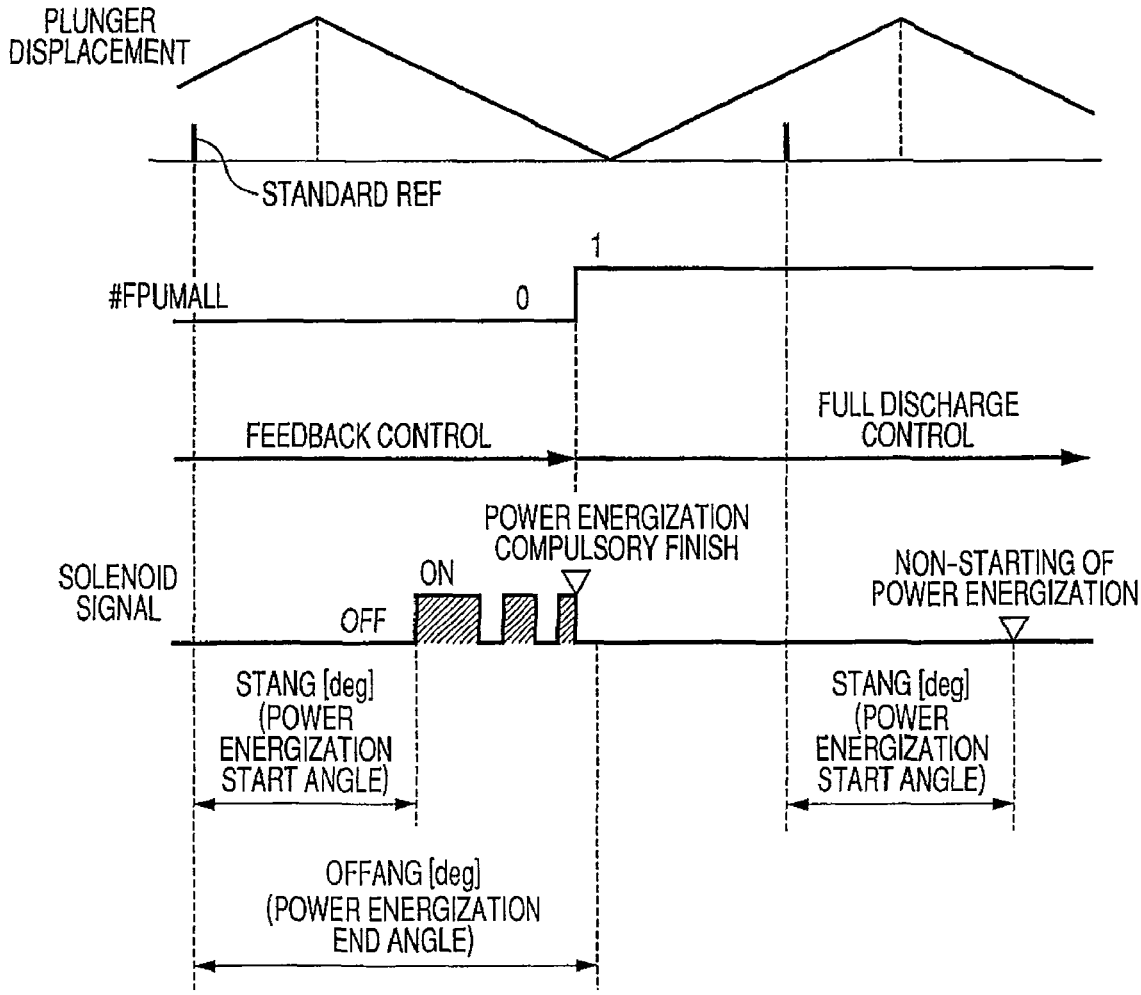
FIG. 33 is a time chart in the case of transient from F/B control to full discharge control in the embodiment.

FIG. 33 is a flow chart in the case of changing from F/B control to full discharge control. When the power energization for the solenoid 200 starts after the power energization start angle STANG from the reference REF, the power energization is compulsory finished at a time point when the full discharge request flag #FPUMPALL=1. By compulsory finish of the power energization, the high-pressure fuel pump 1 starts discharge and executes a discharge quantity increasing request of the engine control unit 515 immediately and accordingly, pressure rising responsibility is improved.

Also, when the full discharge request #FPUMALL=1 before reaching the power energization start angle STANG from the reference REF, the power energization is not starts. Accordingly, surely the full discharge becomes possible and the power consumption and heat quantity reduces.

(Full Discharge Control→F/B Control)

Figure 29:
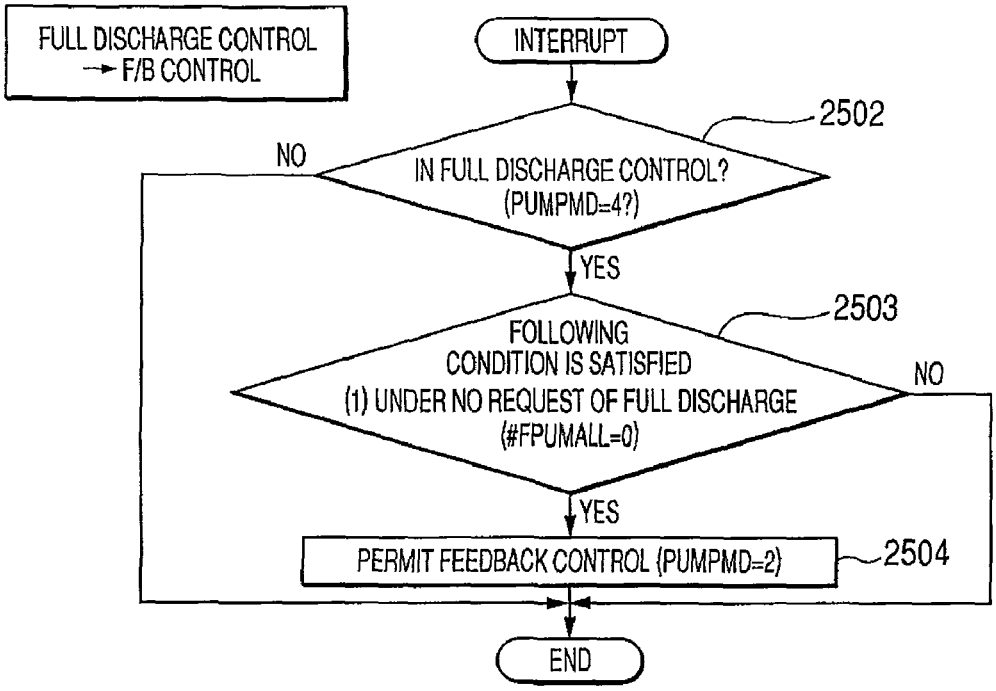
FIG. 29 is a flow chart of transient recognition processing from full discharge control to F/B control at condition (9) in the embodiment.

FIG. 29 is a flow chart of the transient recognition processing from the full discharge control to F/B control when the condition (9) shown in FIG. 14 is satisfied. Firstly, in step 2502, the routine recognizes whether the full discharge control is executed or not, by reading out the pump state variable PUMPD. When now is in the full discharge control, the routine goes to step 2503 and recognizes the presence or absence of the full discharge request.

When no full discharge is requested and the full discharge is finished, the routine goes to step 2504, the F/B control is permitted, and then this routine is ended. Incidentally, when now is not in the full discharge control or the full discharge request is finished, this routine is finished at once.

Figure 34:
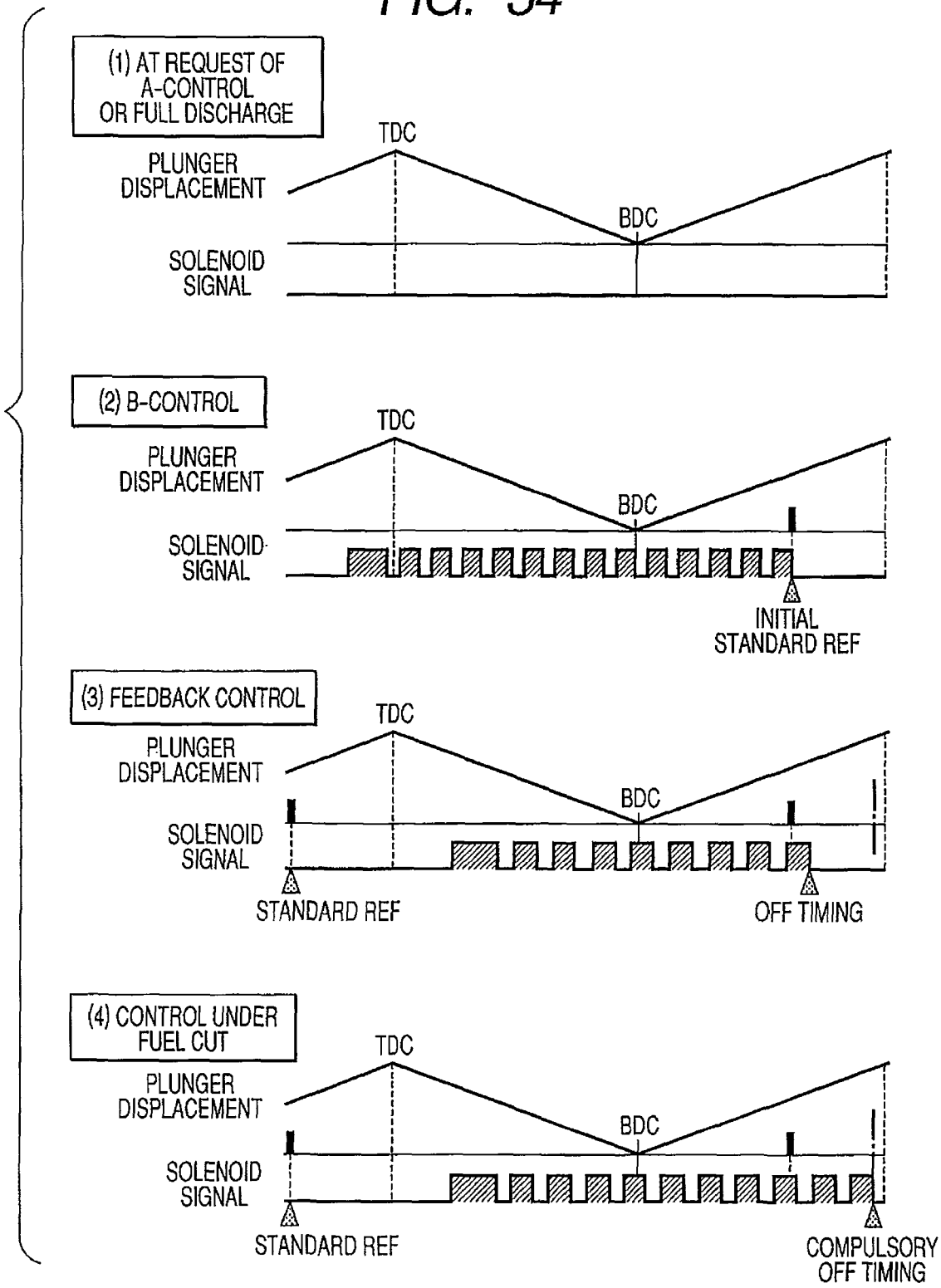
FIG. 34 is a time chart showing an example of power energization signal to solenoid in each control state in the embodiment.

An example of power energization signal for the solenoid 200 in each control condition state is shown in FIG. 34.

(1) The power energization to the solenoid 200 is not carried out when being in the A-control or in the full discharge control.

(2) When being in the B-control, a valve opening current control duty is output from the B-control permission to the first reference REF.

(3) When being in the F/B control, the valve opening current control duty is output from the power energization start angle STANG to the power energization finish angle OFFANG.

(4) In the F/C control, the opening current control duty is output from the power energization start angle STANG to the power energization compulsory finish angle OFFANG.

This embodiment performs the following function by the structure described above.

In the high-pressure fuel pump control apparatus of the in-cylinder injection engine having the injector 54 mounted on the cylinder 507*b*, the high-pressure fuel pump 1 which has a normal close type suction valve and that send pressurized fuel to the injector 54, the common rail 53, and the fuel pressure sensor 56, it is capable of reducing heating quantity of the solenoid 200 provided on the high-pressure pump 1 and supplying a driving signal with wide controllable range.

Additionally, by reducing the heating quantity of the solenoid 200 and enabling to turn ON and OFF with high control responsibility timing, it is capable of stabilizing the furl system and improving the discharge gas properties.

Figure 35:
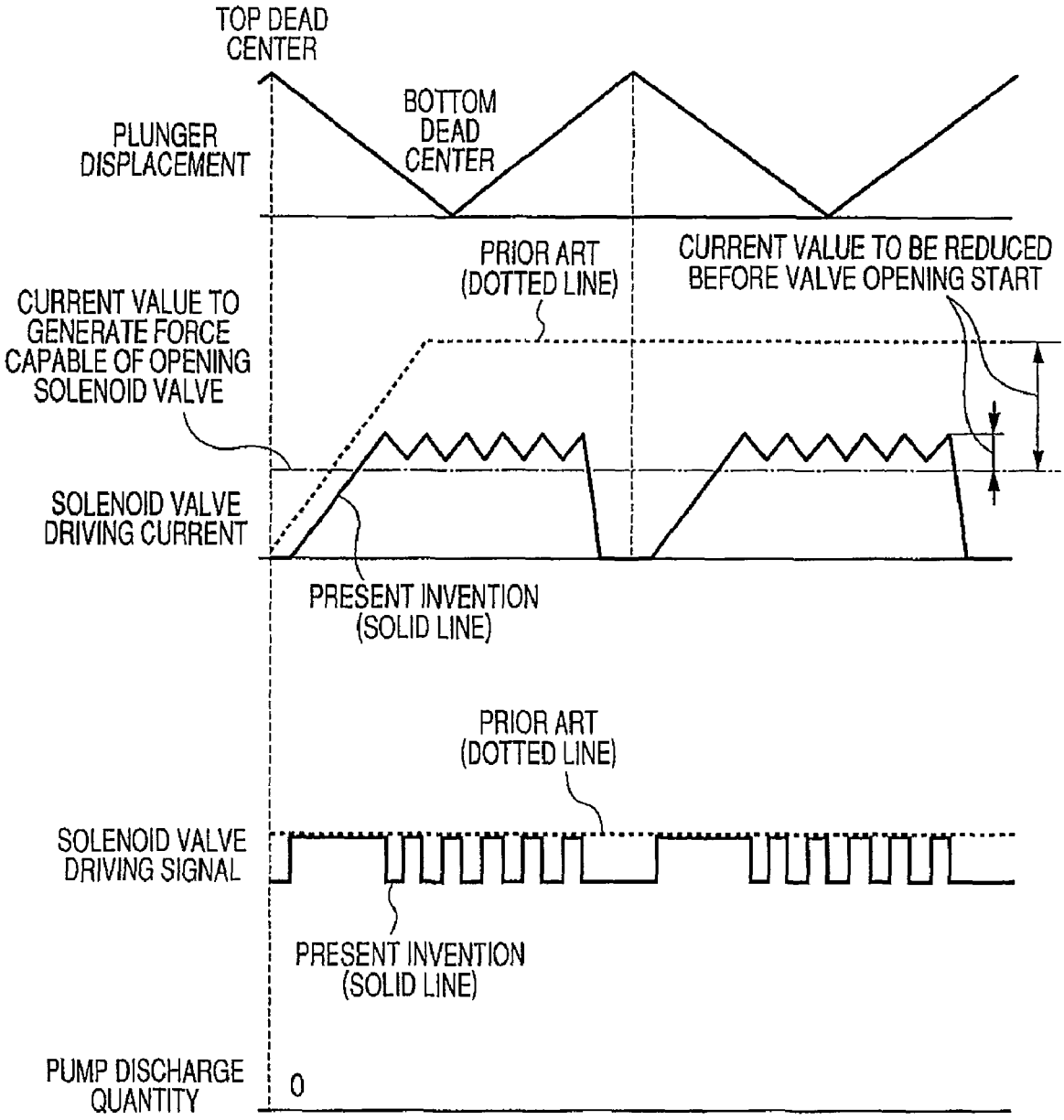
FIG. 35 is a view explaining the effect of the high-pressure fuel pump control apparatus in the embodiment.

An example of effect in the embodiment is explained with reference to FIG. 35. FIG. 35 shows time charts in both of the embodiment of the present invention and the prior art, when making their pump discharge quantity zero.

In the prior art, when making the pump discharge quantity zero, the full power energization is executed to the pump solenoid valve. On the other hand, in the present embodiment, as the valve opening current control is carried out only at appropriate timing, with maintaining pump discharge zero, current consumption is reduced and heating of the solenoid 200 is suppressed.

Also, as the current value is controlled near the current value to generate force capable of opening solenoid valve, shortening the valve opening delay time and controlling the discharging quantity stably are possible up to high velocity revolution of the pump. Additionally, it is capable of stabilizing the fuel system described above and improving the combustion stabilization as well as the emission gas properties.

Advantages of the high-pressure fuel pump according to the embodiments are summarized as follows.

(1) As described above, by considering the engine speed, battery voltage, mounting variations of the pump driving cam 100, and operating angle by the variable valve timing mechanism, the power energization start angle STANG can be set at optimum value. Thereby, the power energization to the solenoid 200 does not start uniformly from the top dead center of the pump plunger (plunger 2), on the way of the charging stroke of the high-pressure fuel pump 1, the power energization maintains the solenoid valve at valve opening state, that is, before start of next discharging stroke after the top dead center of the pump plunger, the ON state output of electric driving signal starts and power energization to the solenoid 200 is carried out to maintain the solenoid valve 8 in opening state. Therefore power consumption and heating quantity are suppressed at minimum and un-intentional pressure rising state is avoided.

(2) Setting the power energization end OFFANG according to the injection quantity by the injector 54 and the engine speed, that is, and setting phase at appropriate phase of ON state output of electrical driving signal become capable of increasing control responsibility.

(3) At fuel cut which pump non-discharging operation is required, by ending the power energization of the solenoid 200 with output compulsory finish angle CPOGGANG set in response to the engine speed, battery voltage, variable valve timing operating angle and or the like, end timing of ON state output of electric driving signal is set at a predetermined phase (restriction phase) by the full power energization of the solenoid valve 200 through the full stroke period of the pump compression stroke in comparison with making non-power energization operation state by full power energization to the solenoid through the full stroke period of the pump compression stroke during the fuel cut, reduction of power consumption and preventing heating of the solenoid valve 200 are realized.

(4) In the feedback compensation control, continuous power energization signal is output during predetermined time (initial power energization time TPUMPON) according to power source voltage, engine speed or the like, as ON state output of the electric driving signal. Thereby, it is able to make solenoid current value reach the current value to generate force capable of solenoid valve opening and after that, by outputting duty signal by duty ratio PUMPRTY, to reduce heating quantity of the solenoid 200 through restricting the upper limit value of the current flowing through the solenoid 200, current decrease during non power energization is accelerated and the valve closing response time is shortened. Accordingly, discharge accuracy is improved and the operation up to high velocity revolution.

(5) Until the decision of the phase between crank angle and pump driving cam angle, full discharge control by non-power energization control, and after engine start, rising of the fuel pressure in the common rail 53 is promoted. If the fuel pressure in the common rail 53 is higher than a predetermined value, full discharge control by non-power energization control is stopped and over fuel pressure in the common rail 53 and the reference REF can be suppressed.

(6) The power source of high-pressure fuel pump 1 is made as a system separated from the ignition switch 519 and after engine install recognition; the routine turns off power source of the high-pressure fuel pump 1. Therefore, the ignition switch 519 turns off during the engine stall, and full discharge continues to the engine stall and the unintentional over pressure rising is avoided.

The embodiments according to the present invention is explained in detail, above, the invention however, is not limited to the above embodiments and it is capable of changing them in designing without departing from the spirit of the invention defined in the claims.

What is claimed is:

1. A control apparatus for a high-pressure fuel pump for an internal combustion engine, wherein the high pressure fuel pump comprising:

a pressurizing member being reciprocated by rotation of a pump driving cam mounted on the internal combustion engine; a pressurized chamber whose volume is varied by reciprocation of the pressurizing member to perform pump action by repeating a charging stroke and a discharging stroke; and a normal close type solenoid valve which is installed as a suction valve in a fuel charging passage to the pressurized chamber such that a pump suction pressure generated in the pressurized chamber in the charging stroke is exerted on the solenoid valve in a valve opening direction, and that is closed at OFF state of an electric driving signal and opened at ON state of the electric driving signal, so that a discharging rate of the high-pressure fuel pump of variable discharge rate type is controlled by an opening and closing control of the normal close type solenoid valve as the suction valve, the control apparatus is configured so that a start time of the ON state output of the electric driving signal for the normal close type solenoid valve as the suction valve is set on the way from a top dead center of the pressurizing member to a bottom dead center thereof in the charging stroke of the high-pressure fuel pump and a finish timing of the ON state output of the electrical driving signal is set on the way from the bottom dead center to the top dead center.

2. The control apparatus according to claim 1, wherein a start phase of the ON state output of the electrical driving signal is variably controlled in accordance with at least one of a power source for the solenoid valve, an engine speed and mounting variations of the pump driving cam.

3. The control apparatus according to claim 1, wherein a finish phase of the ON state output of the electrical driving signal is variably controlled in accordance with an injection quantity with an injection valve.

4. The control apparatus according to claim 1, wherein the finish timing of the ON state output of the electrical driving signal is limited to a predetermined phase on the way from the bottom dead center of the pressurizing member to the top dead center thereof.

5. The control apparatus according to claim 1, wherein the limited phase of the finish timing is variably controlled in accordance with at least one of a power source voltage of the solenoid valve and an engine speed.

6. The control apparatus according to claim 1, wherein the finish timing of the ON state output of the electrical driving signal is set to the limited phase during fuel cut.

7. The control apparatus according to claim 1, wherein the electrical driving signal is configured by a first energization signal part continuously output initially during a predetermined time period as an ON state output and a second energization signal part output with duty signal after the first energization signal part.

8. The control apparatus according to claim 1, wherein an On state of the electric driving signal is configured by a first energization signal part continuously output initially during a predetermined time period and a second energization signal part output with duty signal after the first energization signal part.

9. The control apparatus according to claims 8, wherein the continuous power energization time of the first power energization signal part of the electric driving signal is variably controlled in accordance with at least one of a power source voltage of the solenoid valve and an engine speed.

10. The control apparatus according to claim 8, wherein the duty ratio of the second energization signal part of the electric driving signal is variably controlled in accordance with at least one of the power source voltage and an engine speed.

11. The control apparatus according to claims 8, wherein the first energization signal part as the continuous power energization is longer than ON time in one periodic time of the duty signal.

12. The control apparatus according to claim 1, wherein the ON state output of the electrical driving signal starts till the time when the phase between a crank angle of the internal engine and the pump driving cam angle is confirmed.

13. The control apparatus according to claim 12, wherein output permission of the electrical driving signal is recognized based on an accumulator of the common rail.

14. The control apparatus for an internal combustion engine according to claim 1, the output of the driving signal is stopped when the requested pump discharge quantity exceeds the threshold value.

15. The control apparatus according to claim 14, wherein the threshold value of the requested pump discharge rate is calculated by at least one of throttle valve opening degree, target air-fuel ratio and engine speed.

16. The control apparatus according to claim 1, after recognition of an engine stall, a power source of the high-pressure pump is cut off.

* * * * *